US006129443A

United States Patent [19]

Murata et al.

[11] Patent Number: 6,129,443

[45] Date of Patent: Oct. 10, 2000

[54] WATERPROOF COVER MECHANISM FOR BELT-LIKE LIGHTING FITTING, ILLUMINATOR, AND OUTDOOR LIGHTING SYSTEM

[75] Inventors: Kazuaki Murata, Tokyo; Katunori Sato, Tochigi, both of Japan

[73] Assignee: Moriyama Sangyo Kabushiki Kaisha, Japan

[21] Appl. No.: 09/214,060

[22] PCT Filed: Aug. 1, 1997

[86] PCT No.: PCT/JP97/02682

§ 371 Date: May 14, 1999

§ 102(e) Date: May 14, 1999

[87] PCT Pub. No.: WO98/49491

PCT Pub. Date: Nov. 5, 1998

[30] Foreign Application Priority Data

Apr. 28, 1997 [JP] Japan ..... 9-110857

[51] Int. Cl.[7] ..... F21V 31/00

[52] U.S. Cl. ..... 362/267; 362/237; 362/249; 362/225; 439/280; 439/519

[58] Field of Search ..... 439/280, 519, 439/521, 605; 362/226, 236, 237, 244, 249, 267, 391, 222, 225

[56] References Cited

U.S. PATENT DOCUMENTS 3,015,717 1/1962 Angier ..... 362/267

4,482,944 11/1984 Roossine et al. ..... 362/225

4,841,420 6/1989 Baggio et al. ..... 362/391

5,161,881 11/1992 Myson ..... 439/280

5,622,425 4/1997 Lin ..... 362/249

*Primary Examiner*—Alan Cariaso

*Attorney, Agent, or Firm*—Morrison Law Firm

[57] ABSTRACT

A strip-mounted luminaire (1) has a ribbon cable (11), to the front side of which sockets (12) are connected. An illuminant (13) is mounted on each socket (12). Each watertight cover mechanism (2) has a base member (51) which is provided with a window (72) adapted to permit a socket (12) of the strip-mounted luminaire (1) to be inserted therein; a back end member (52) for holding the ribbon cable (11) in conjunction with the base member (51) in such a state that the ribbon cable (11) is sandwiched between the base member (51) and the back end member (52); a translucent globe (53) adapted to be attached to the base member (51) so as to enclose the socket (12) and the illuminant (13); a first sealing member (54) for sealing and waterproofing the space around the socket (12); and a second sealing member (55) for sealing and waterproofing the gap between the translucent globe (53) and the base member (51). The strip-mounted luminaire (1) and the watertight cover mechanism (or the watertight cover mechanisms) (2) constitute a lighting fixture.

13 Claims, 25 Drawing Sheets

WATERPROOF COVER MECHANISM FOR BELT-LIKE LIGHTING FITTING, ILLUMINATOR, AND OUTDOOR LIGHTING SYSTEM

TECHNICAL FIELD

The present invention relates to a watertight cover mechanism to cover a strip-mounted luminaire in a waterproof state, and also relates to a lighting fixture and an outdoor lighting system adapted to use said watertight cover mechanism for a strip-mounted luminaire.

BACKGROUND ART

As an example of conventional luminaires, Japanese Utility Model Publication No. 1988-38482 discloses a strip-mounted luminaire to be used for decorative illumination or other purposes. This strip-mounted luminaire includes sockets which are adapted to be arranged on a ribbon cable in such a state that the sockets pierce through the insulation coating of the ribbon cable and are connected to the conductive material of the cable, and electric bulbs to be set in the sockets.

However, the luminaire disclosed in the above publication has a too much height to maintain a good balance, because each socket is designed to removably receive an electric bulb having a single, wedge-type base in such a state that the electric bulb is vertically positioned. Furthermore, as such an electric bulb normally has a vertically positioned filament or a crest-shaped filament, the light distributed in the lengthwise direction of the ribbon cable forms a circle, which is not suitable for in-line illumination.

Luminaires that are arranged in a line and used outdoors for decorative illumination or other purposes have to be waterproof so as to be protected from rain. An example of the luminaires of this type is disclosed in Japanese Patent Laid-open 1995-169313. The luminaire disclosed in this patent calls for sandwiching the cable, along a portion located at a distance from the ends of the cable, between the seat portion and the cap portion(s) of a socket so that the socket supports and electrically connects the cable at the same time. This luminaire also includes a translucent globe made of a transparent synthetic resin. A channel for supporting an O-ring is formed around the neck portion of the translucent globe so that the translucent globe can be fitted in a socket in a waterproof state by forcing the neck portion of the translucent globe into an annular skirt formed on the seat portion of the socket.

The aforementioned luminaire disclosed in Japanese Utility Model Publication No. 1988-38482 is not suitable to be used outdoors, because it is not waterproof. The luminaire disclosed in Japanese Patent Laid-open No. 1995-169313 is provided with a mechanism to attach a globe in a waterproof state and, therefore, may be used outdoors.

On the other hand, the waterproof mechanism for the luminaire disclosed in Japanese Patent Laid-open No. 1995-169313 calls for providing the translucent globe with a neck portion and inserting the neck portion into the skirt of a socket, thereby pressing the O-ring of the neck portion against the inner surface of the skirt. Considering the size of a typical translucent globe with respect to the size of an electric bulb, the diameter of the neck portion is limited. For this reason, the application of the above configuration is limited to such cases that the electric bulb is used at a vertical position. In other words, it is not applicable to cases where the electric bulb is used at a horizontal position, because its horizontal dimension becomes too long.

Furthermore, it is difficult to be applied to a socket having an irregular shape.

The structure disclosed in the above patent also calls for snugly inserting a protruding portion that protrudes from the seat portion into a cap portion to affix the cap portion to the seat portion, and inserting pins that protrude from the seat portion into the cable in order to perform the necessary electrical connection. As a result, the depth of the cap portion, i.e. the distance by which the cap portion projects rearward from the cable, becomes excessively long, making it difficult to arrange lamps in a line on the surface of a building or other structure as well as making the position of the lamp too high to be easily mounted.

The above configuration presents another problem in that production costs are high, because its translucent globe has a neck portion and therefore has to be formed by blow molding.

Japanese Utility Model Laid-open No. 1994-23166 discloses another luminaire that has a structure similar to that of Japanese Patent Public Laid-open No. 1995-169313 and presents similar problems. The luminaire disclosed in said publication has a structure that calls for attaching a neck portion of a translucent globe through a cover holder to a cable, to which a socket is connected, so that the translucent globe may be engaged in the socket by hooking a fitting hook between the cable and the neck portion.

However, this structure is not only difficult to be applied to a socket having an irregular shape, but it also presents the danger of the load applied by the fitting hook to the cable causing problems in the cable.

An object of the present invention is to provide a watertight cover mechanism to cover a strip-mounted luminaire in a waterproof state, wherein said watertight cover mechanism is capable of enveloping a socket and an illuminant so as to waterproof them regardless of the shape of the socket or the orientation of the illuminant mounted in the socket, reducing the distance by which the luminaire protrudes from the back of the ribbon cable, permitting the luminaire to be easily mounted on a surface of a building or other structure, and also enabling the production of the translucent globe at a low cost. Another object of the invention is to provided a lighting fixture and an outdoor lighting system adapted to use said watertight cover mechanism for a strip-mounted luminaires

DISCLOSURE OF INVENTION

A watertight cover mechanism for a strip-mounted luminaire according to the present invention is adapted to be mounted on a strip-mounted luminaire that includes a ribbon cable, a socket connected to the ribbon cable and an illuminant set in the socket, said watertight cover mechanism including a base member which is provided with a window adapted to permit a socket to be inserted therethrough, a back end member adapted to hold said ribbon cable in such a manner that the ribbon cable is sandwiched between the base member and the back end member, a translucent globe adapted to be fitted around the base member in such a state as to enclose said socket and the illuminant set in the socket, a first sealing member adapted to be arranged on the base member so as to watertightly seal the space around the socket, and a second sealing member for sealing the gap between the base member and the translucent globe. By using the base member, the back end member, the translucent globe, and the first and second sealing members as described above, the strip-mounted luminaire can be watertightly sealed together with its ribbon cable. Thus, the invention provides a strip-mounted luminaire with a watertight cover mechanism which is capable of making a socket and its illuminant waterproof regardless of the orientation of the socket and the illuminant mounted on the ribbon cable. In addition, said watertight cover mechanism is easy to mount on the surface of a building or other structure because of the reduced distance by which the watertight cover mechanism protrudes from the back of the ribbon cable, and its translucent globe can be formed at low cost.

A lighting fixture according to the present invention includes a strip-mounted luminaire including a ribbon cable having a plurality of conductive members embedded in an insulating cover in such a state that the conductive members are insulated from one another, a socket and an illuminant set in said socket, which pierces through the insulating cover of the ribbon cable and is connected to the conductive members; a base member which is adapted to be disposed on the ribbon cable of the strip-mounted luminaire and provided with a window so formed as to permit said socket to be inserted therethrough; a back end member adapted to hold said ribbon cable in such a manner that the ribbon cable is sandwiched between the base member and the back end member; a translucent globe adapted to be fitted around the base member in such a state as to enclose said socket and the illuminant set in the socket; a first sealing member adapted to be arranged on the base member so as to seal the space around the socket in a waterproof state; and a second sealing member for sealing the gap between the base member and the translucent globe in a waterproof state. By using the first sealing member for watertightly sealing the space around the socket and the second sealing member for watertightly sealing the open end of the translucent globe as described above, the invention provides a lighting fixture having a strip-mounted luminaire which is capable of making a socket and its illuminant waterproof regardless of the orientation of the socket and the illuminant mounted on the ribbon cable. In addition, said lighting fixture is easy to mount on the surface of a building or other structure because of the reduced distance by which the components protrude from the back of the ribbon cable, and its translucent globe can be formed at low cost.

According to another feature of the invention, the first sealing member is disposed between the socket and the base member. By disposing the first sealing member in such a manner as to make use of the outer circumferential surface of the socket, the invention provides a lighting fixture that uses a strip-mounted luminaire having a simplified structure.

According to yet another feature of the invention, the first sealing member is disposed between the base member and the back end member. By disposing the first sealing member between the base member and the back end member so as to seal the space around the socket, the invention provides a lighting fixture which ensures reliable sealing regardless of the shape of the socket.

According to yet another feature of the invention, a plurality of sockets and illuminants are arranged in the lengthwise direction of the ribbon cable. By thus arranging numerous sockets and illuminants, the invention offers a lighting fixture which is capable of conducting in-line illumination outdoors.

According to yet another feature of the invention, the ribbon cable is provided with three or more conductive members, of which at least two conductive members are used to connect the ribbon cable to the power supply while at least one conductive member is not connected to the power supply; a plurality of sockets and illuminants are arranged in the lengthwise direction of the ribbon cable; and a plurality of illuminant groups, each of which consists of a plurality of illuminants connected in series via said conductive member(s) that is (are) not connected to the power supply, are formed, said illuminants groups arranged between the power supply-connected conductive members and connected thereto in parallel with one another. By using a ribbon cable having three or more conductive members, of which at least two conductive members are connected to the power supply as described above, the invention is capable of providing a lighting fixture which does not require a step-down transformer.

According to yet another feature of the invention, each socket has a socket body made of an insulating material and a pair of contact pieces, wherein said socket body includes a base portion extending in the lengthwise direction of the ribbon cable, a pair of insertion portions respectively raised from the two opposing ends of the base portion, a pair of insertion grooves respectively formed in the two insertion portions at the opposing locations, and spaces respectively formed in the two insertion portions in such a manner that each space communicates with the corresponding insertion groove, and said contact pieces penetrate through the insulating cover of the ribbon cable and are connected to the conductive members in such a state that the contact pieces are respectively contained in the spaces of the insertion portions and face the insertion grooves. Each illuminant is a compact, baseless incandescent lamp having a glass bulb, a pair of pinch seal portions respectively formed at the two opposing ends of the glass bulb, a pair of lead wires respectively and airtightly inserted in the pinch seal portions, and a filament disposed in the glass bulb, each lead wire having the portion that is contained in the glass bulb and forms a filament supporting portion and the portion that is located outside the glass bulb and forms a connector loop adapted to be inserted into the corresponding insertion groove of the socket and connected to the corresponding contact piece, and said filament laid across the pair of filament supporting portions and connected thereto. As described above, the invention provides a lighting fixture having an appealing appearance, wherein each illuminant is a compact, baseless incandescent lamp sealed at both ends, and each socket has a socket body made of an insulating material.

According to yet another feature of the invention, each socket has a socket body made of an insulating material and a pair of contact pieces, wherein said socket body includes a base portion extending in the lengthwise direction of the ribbon cable, a pair of insertion portions respectively raised from the two opposing ends of the base portion, a pair of insertion grooves respectively formed in the two insertion portions at the opposing locations, and spaces respectively formed in the two insertion portions in such a manner that each space communicates with the corresponding insertion groove; and said contact pieces penetrate through the insulating cover of the ribbon cable and are connected to the conductive members in such a state that the contact pieces are respectively contained in the spaces of the insertion portions and face the insertion grooves. Each illuminant is a compact, baseless incandescent lamp having a glass bulb, a pair of pinch seal portions respectively formed at the two opposing ends of the glass bulb, a pair of lead wires respectively and airtightly inserted in the pinch seal portions, and a filament disposed in the glass bulb, each lead wire having the portion that is contained in the glass bulb and forms a filament supporting portion and the portion that is located outside the glass bulb and forms a connector loop adapted to be inserted into the corresponding insertion groove of the socket and connected to the corresponding contact piece, and said filament laid across the pair of filament supporting portions and connected thereto. The invention also includes a reflector disposed between the base portion of each socket body and the illuminant set therein. By providing a reflector between the base portion of each socket body and its illuminant, the invention provides a lighting fixture which is capable of controlling the luminous intensity distribution and shielding the socket from heat.

According to yet another feature of the invention, the base member is formed in a generally disk-like shape and has a pair of fitting portions symmetrically formed along the circumferential edge of the back end of the base member and adapted to fit the ribbon cable to the base member, a window formed between said pair of fitting portions and adapted to permit a socket to be inserted therethrough, a pair of arc-shaped base-side fastening portions respectively formed at two opposing sides of the window, a window frame portion which is formed at a location inside the base-side fastening portions and outside the window and has a first loop groove adapted to contain the first sealing member in such a manner that the first sealing member is positioned between the socket and the first loop groove, and an annular ridge having a second loop groove which is formed around the outer circumferential face of the base member and adapted to contain the second sealing member. The back end member is formed in a generally disk-like shape and has seating portion formed at the approximate center of the surface of the back end member and adapted to receive the ribbon cable thereon, and a pair of arc-shaped back-end-side fastening portions flanking said seating portion and adapted to be fastened to the aforementioned base-side fastening portions. The translucent globe has a generally hemi-spherical shape and has a circular open end so that the translucent globe can be attached to the base member with the open end of the translucent globe fitted around the outer circumferential face of the annular ridge. Thus, the invention provides a lighting fixture having the optimum configuration for the function of the first sealing member by using the outer face of the socket.

According to yet another feature of the invention, the base member is formed in a generally disk-like shape and has a pair of fitting portions symmetrically formed along the circumferential edge of the back end of the base member and adapted to fit the ribbon cable to the base member, a window formed between said pair of fitting portions and adapted to permit a socket to be inserted therethrough, a pair of arc-shaped base-side fastening portions respectively formed at two opposing sides of the window, a loop ridge which is formed at a location inside the base-side fastening portions and outside the socket and adapted to contain the first sealing member, and an annular ridge having a loop groove which is formed around the outer circumferential face of the base member and adapted to contain the second sealing member. The back end member is formed in a generally disk-like shape and has seating portion formed at the approximate center of the surface of the back end member and adapted to receive the ribbon cable thereon, a pair of arc-shaped backend-side fastening portions flanking said seating portion and adapted to be fastened to the aforementioned base-side fastening portions, a ridge portion facing the aforementioned loop ridge at a distance therewith so that the ridge portion and the loop ridge together form a groove for containing the first sealing member, and a push portion adapted to push the first sealing member into said groove. The translucent globe has a generally hemi-spherical shape and has a circular open end so that the translucent globe can be attached to the base member with the open end of the translucent globe fitted around the outer circumferential face of the annular ridge. Thus, the invention provides a lighting fixture which has the optimum configuration to enable the first sealing member to function between the base member and the back end member and is therefore capable of effectively sealing the socket in a waterproof state regardless of the shape of the socket.

According to yet another feature of the invention, the base member and the back end member are fastened together by means of ultrasonic welding. By thus welding the base member and the back end member to each other by means of ultrasonic welding, the invention is capable of providing a lighting fixture which has sufficient fastening strength.

According to yet another feature of the invention, the base member and the back end member are fastened together with tapping screws. By thus fastening the base member and the back end member together with tapping screws, the invention is capable of providing a lighting fixture which is easy to produce and has sufficient fastening strength.

According to yet another feature of the invention, the base member is formed in a generally disk-like shape and has a plurality of catching grooves around its outer edge, while the translucent globe has a generally hemi-spherical shape and is provided with a circular open end and a plurality of catching ridges, which are formed on the inner edge of the open end and adapted to be engaged in the catching grooves of the base member. By thus engaging the catching ridges of the translucent globe in the catching grooves of the base member, the invention is capable of providing a lighting fixture which presents no danger of the translucent globe inadvertently falling off.

According to yet another feature of the invention, the base member is formed in a generally disk-like shape and has a plurality of catching lips formed around its outer edge, while the translucent globe has a generally hemi-spherical shape and is provided with a circular open end and a plurality of catching grooves, which are formed along the inner edge of the open end and adapted to be engaged with the catching lips of the base member. By thus engaging the catching grooves of the translucent globe with the catching lips of the base member, the invention is capable of providing a lighting fixture which presents no danger of the translucent globe inadvertently falling off and has an appealing appearance because there are no parts protruding out of the translucent globe.

According to yet another feature of the invention, mounting holes are formed in the back of the back end member. By thus forming mounting holes in the back of the back end member, the invention provides a lighting fixture which is easy to install.

According to yet another feature thereof, the invention includes mounting holes formed in the back of the back end member, and an adapter which is designed to be fastened in the mounting holes in the back of the back end member and has mounting portions respectively projecting from two opposing locations of the back end member. With the configuration as above, the invention provides a lighting fixture which can easily be installed from the front side by mounting the adapter using the mounting holes in the back of the back end member.

According to yet another feature thereof, the invention includes mounting holes formed in the back of the back end member, and a cord-shaped member adapter to be fastened in the mounting holes in the back of the back end member. With the configuration as above, the invention provides a lighting fixture which can be attached to a cord-shaped member, such as a wire, by mounting the cord-shaped member adapter by using the mounting holes in the back of the back end member.

An outdoor illumination system according to the invention includes a lighting fixture which is provided with a strip-mounted luminaire comprising a ribbon cable to be arranged on the surface of a building or other structure, a plurality of sockets arranged on the ribbon cable in the lengthwise direction thereof and connected thereto, and a plurality of illuminants respectively set in said sockets; base members, each of which has a window adapted to permit a socket of the strip-mounted luminaire to be inserted therethrough; back end members for holding the ribbon cable in conjunction with the base members in such a state that the ribbon cable is sandwiched between the base members and the back end members; translucent globes respectively attached to the base members in such a state that each translucent globe enclose one of said sockets and the illuminant set therein; first sealing members respectively arranged on said base members so that each first sealing member seals the space around the corresponding socket in a waterproof state; and second sealing members, each of which is adapted to seal the gap between the corresponding base member and the translucent globe. The outdoor illumination system further includes a fixing means for affixing the lighting fixture to the aforementioned building (or other structure), and a power supply connected to the ribbon cable. Thus, the invention provides an outdoor illumination system which is capable of installing a strip-mounted luminaire over the surface of a building or other structure.

BEST MODE FOR CARRYING OUT THE INVENTION

Figure 1:
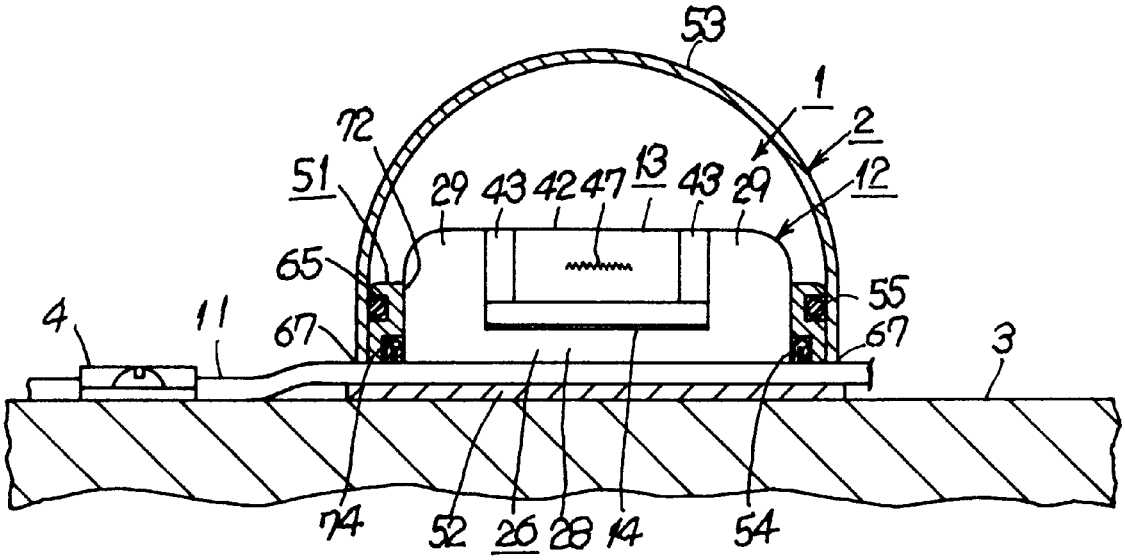
FIG. 1 is a sectional view (a sectional bottom view) of a lighting fixture which is provided with a strip-mounted luminaire and a watertight cover mechanism according to a first embodiment of the present invention.

Next, the embodiments of the present invention is described in the following by referring to the drawings.

The first embodiment is shown in FIGS. 1 through 16. FIG. 1 is a sectional view (a sectional bottom view) of a lighting fixture which is provided with a strip-mounted luminaire and a watertight cover mechanism.

In FIG. 1, numeral 1 denotes a strip-mounted luminaire, numeral 2 a watertight cover mechanism, numeral 3 a building or a structure to mount the lighting fixture thereon, and numeral 4 a mounting saddle serving as a fixing means.

Figure 2:
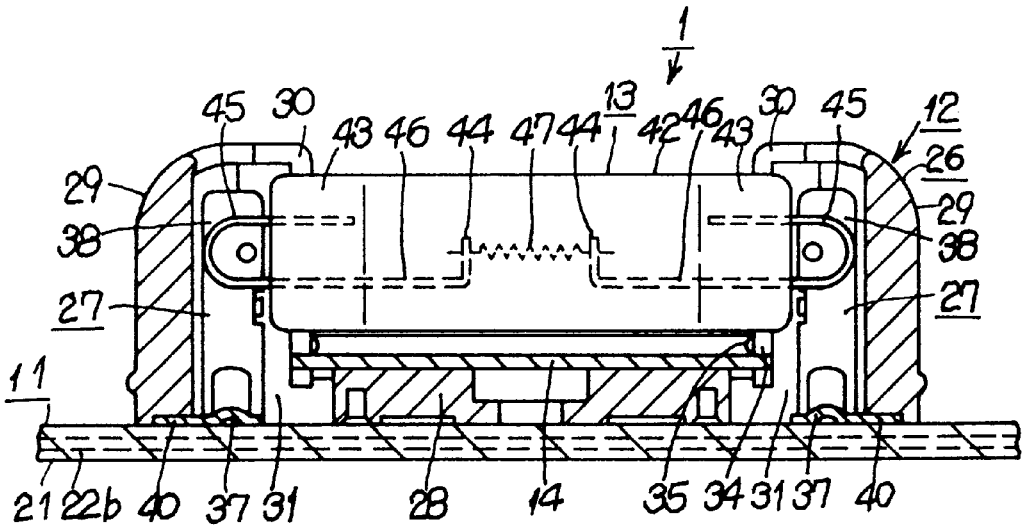
FIG. 2 is an enlarged sectional view (an enlarged sectional bottom view) of said strip-mounted luminaire.
Figure 3:
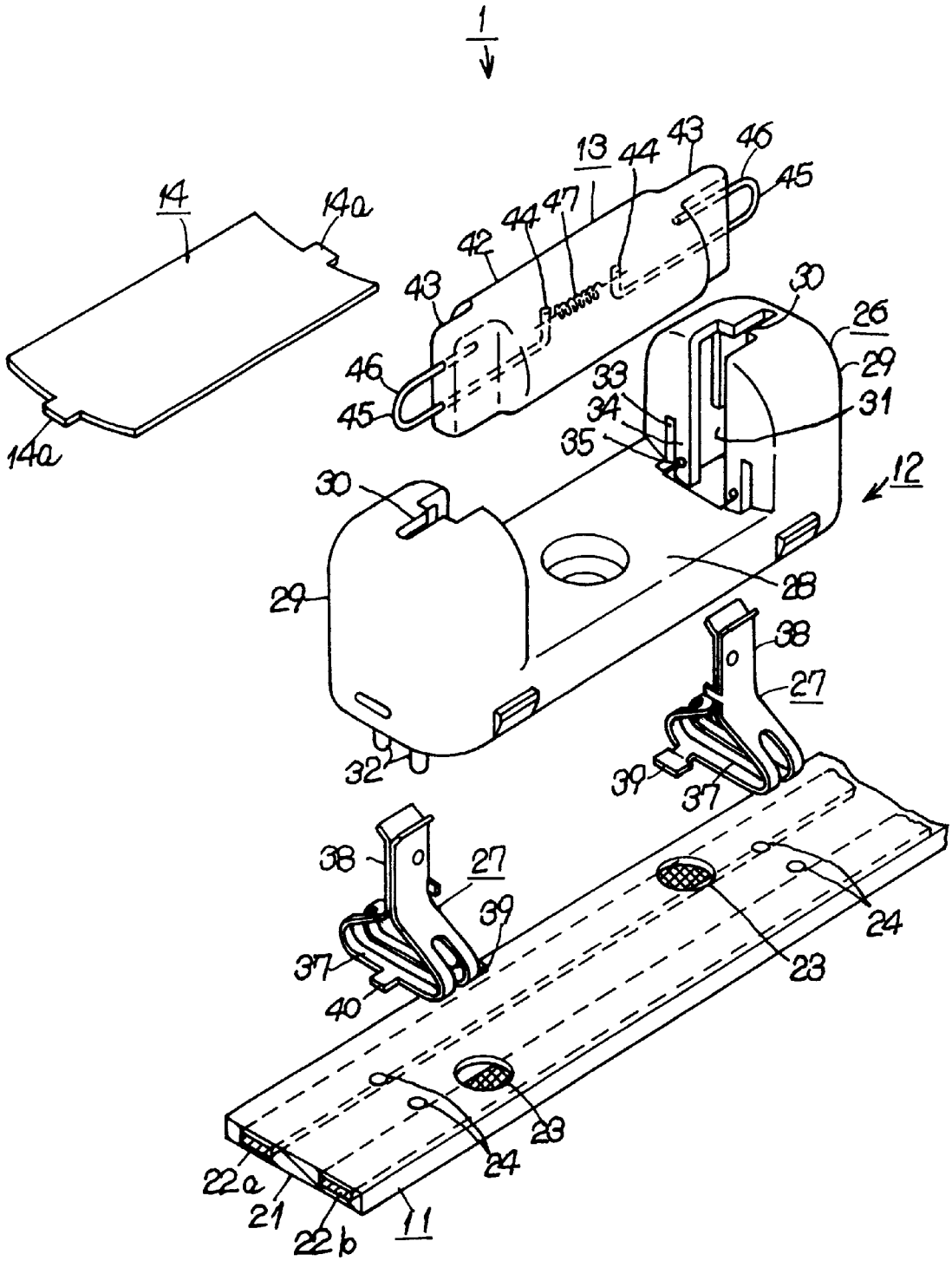
FIG. 3 is an exploded perspective view of said strip-mounted luminaire.

First, the strip-mounted luminaire 1 is explained hereunder, referring to FIGS. 2 and 3 in addition to FIG. 1. FIG. 2 is an enlarged sectional view (an enlarged sectional bottom view) of the strip-mounted luminaire, and FIG. 3 is an exploded perspective view of the strip-mounted luminaire.

The strip-mounted luminaire 1 has a ribbon cable 11, a socket 12, an illuminant 13 and a reflector 14.

The ribbon cable 11 comprises two braided conductive members 22*a*,22*b* which are embedded in a flat, ribbon-like insulating cover 21 so that the conductive members 22*a*,22*b* are insulated from each other. Conductive member exposed portions 23 and mounting holes 24,24 are formed in the ribbon cable 11, at locations such that each conductive member exposed portion 23 and each pair of mounting holes 24,24 correspond to each contact piece 27 of the socket 12.

The socket 12 includes a socket body 26 made of an insulating material such as a synthetic resin, and a pair of contact pieces 27,27.

The socket body 26 comprises a base portion 28, which extends along the lengthwise direction of the ribbon cable 11, and a pair of insertion portions 29 raised from the two lengthwise ends of the base portion 28. Each insertion portion 29 is provided with an insertion groove 30 and a space 31, the insertion groove 30 formed in the inner surface of the insertion portion 29, i.e. the surface facing the other insertion portion 29, and the space 31 located inside the insertion portion 29. A pair of mounting pins 32 protruding downward are formed on the underside of the socket body 26. A pair of slits 33 are form in each insertion portion 29 of the socket body 26, in the surface of the insertion portion 29 opposing the other insertion portion 29. Each pair of slits 33 oppose each other with the space 31 therebetween so that a leg piece 34 is formed between the space 31 and each slit 33. A protrusion 35 is formed on each leg piece 34.

Each contact piece 27 is formed by bending a conductive spring member and comprises a bottom portion 37, receiving blade portions 38 that are respectively raised and curved from the two ends of the bottom portion 37, a connector portion 39 protruding sideward from one side of the bottom portion 37, and a support portion 40 protruding in the opposite direction from the other side of the bottom portion 37. The contact pieces 27 are adapted to be respectively inserted into the spaces 31 of the insertion portions 29 of the socket body 26 so that the receiving blade portions 38 face the walls of the insertion grooves 30.

In order for the socket 12 to be attached to the ribbon cable 11, the conductive members 22*a*,22*b* are exposed at the locations intended for the connection to the socket by removing the corresponding portions of the insulating cover 21 of the ribbon cable 11. Then, the connector portion 39 of each contact piece 27 is placed over each respective pair of conductive members 22*a*,22*b* and connected thereto by means of spot welding. Thereafter, an insulation treatment is conducted by filling the gaps with silicone resin. In this state, the support portions 40 of the contact pieces 27 are in contact with the surface of the insulating cover 21 so that the contact pieces 27 are snugly supported by the ribbon cable 11. After the contact pieces 27 are attached to the ribbon cable 11, the socket body 26 is placed over the contact pieces 27 so that the contact pieces 27 are respectively fitted in the spaces 31 of the insertion portions 29. The mounting pins 32 of the socket body 26 are fitted in the mounting holes 24, which have been formed in the insulating cover 21 of the ribbon cable 11 beforehand, and the end of each mounting pin 32 projected from the back side of the ribbon cable 11 is deformed by heat. Thus, the mounting of the socket 12 on the ribbon cable 11 is completed.

The illuminant 13 is a small, incandescent lamp having no base, and includes an elongated glass bulb 42, a pair of pinch seal portions 43 respectively formed at the two opposing ends of the glass bulb 42, and a pair of lead wires 46 respectively inserted in the pinch seal portions 43. The portion of each lead wire 46 located inside the glass bulb 42 has a filament supporting portion 44, while the portion outside the glass bulb 42 is bent into a semicircular or U-shaped connector loop 45. The illuminant 13 is also provided with a straight filament 47 that is laid across the filament supporting portions 44 of the lead wires 46 and connected thereto. The glass bulb 42 hermetically contains xenon gas.

The reflector 14 has a curved surface that covers the glass bulb 42 of the illuminant 13 and supported by the protrusions 35 of the leg pieces 34, which are respectively formed opposite each other at the two insertion portions 29 that are located at both ends of the socket body 26. Thus, the reflector 14 is prevented from being inadvertently displaced from the socket body. In order to position the reflector 14, a protrusion 14*a* adapted to be fitted in the insertion groove 30 of the corresponding insertion portion 29 of the socket body 26 is formed at each end of the reflector 14.

With the configuration as above, the illuminant 13 can be mounted on the socket 12 by holding the glass bulb 42 and inserting the connector loops 45 and the pinch seal portions 43 into the insertion grooves 30 of the socket body 26 so that the connector loops 45 become engaged with the respective receiving blade portions 38 of the contact pieces 27, thereby completing the mechanical and electrical connection. The illuminant 13 can be removed from the socket 12 by reversing the above process.

Next, the watertight cover mechanism 2 is explained hereunder, referring to FIG. 1.

The watertight cover mechanism 2 has a base member 51, a back end member 52, a translucent globe 53, a first sealing member 54 and a second sealing member 55.

The base member 51 is disposed at the front end of the strip-mounted luminaire 1 in such a state that the socket 12 of the strip-mounted luminaire 1 is inserted through the base member 51; the translucent globe 53 is fitted around the outer face of the base member 51; and that the ribbon cable 11 is in contact with the back end of the base member 51.

The ribbon cable 11 is held between the base member 51 and the back end member 52.

By being attached to the base member 51, the translucent globe 53 encloses the socket 12 and the illuminant 13.

The first sealing member 54 is disposed between the base member 51 and the socket 12 and seals and waterproofs the space around the socket 12.

The second sealing member 55 is disposed between the base member 51 and the translucent globe 53 and seals and waterproofs the gap between the base member 51 and the translucent globe 53.

Next, the watertight cover mechanism 2 is explained in detail, referring to FIGS. 4 through 16.

First, the base member 51 is explained, referring to FIGS. 4 through 7.

Figure 4:
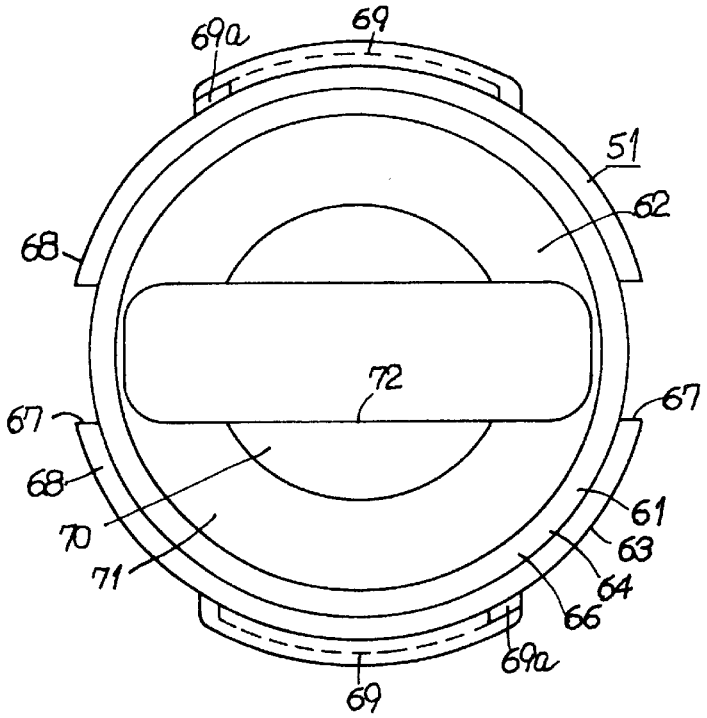
FIG. 4 is a front view of a base member of said watertight cover mechanism.
Figure 5:
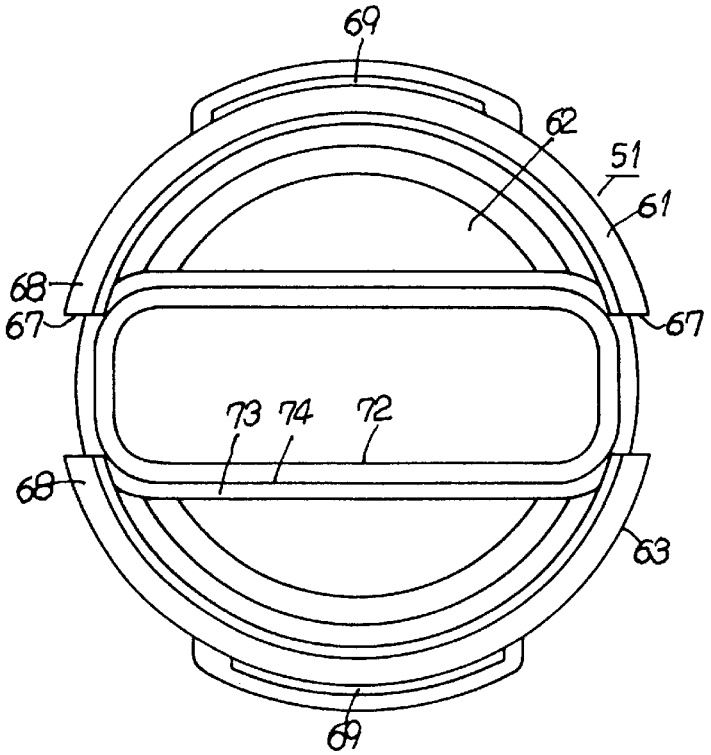
FIG. 5 is a back view of the base member of the watertight cover mechanism.
Figure 6:
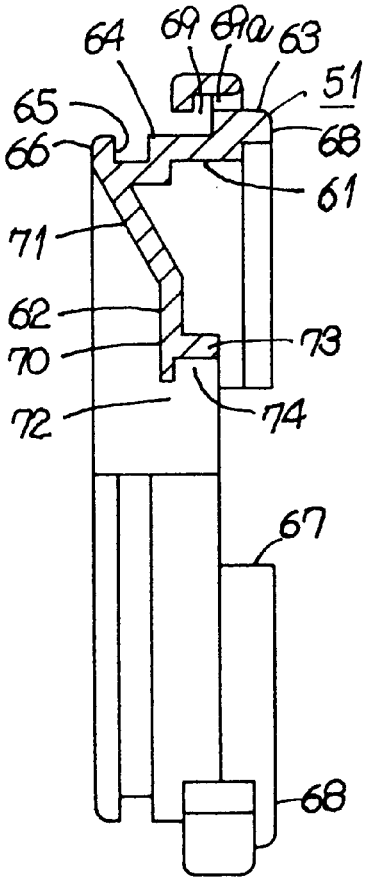
FIG. 6 is a partially sectional right side view of the base member of the watertight cover mechanism.
Figure 7:
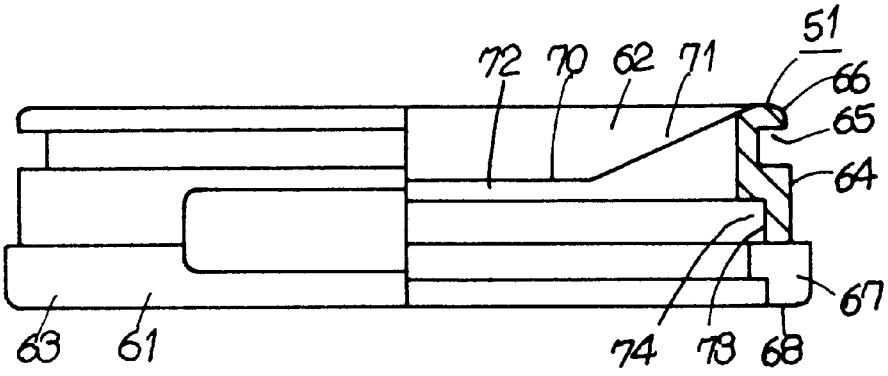
FIG. 7 is a partially sectional bottom view of the base member of the watertight cover mechanism.

FIG. 4 is a front view of the base member 51 of the watertight cover mechanism 2; FIG. 5 is a back view of the base member 51 of the watertight cover mechanism 2; FIG. 6 is a partially sectional right side view of the base member 51 of the watertight cover mechanism 2; and FIG. 7 is a partially sectional bottom view of the base member 51 of the watertight cover mechanism 2.

The base member 51 is formed in a generally disk-like shape by molding transparent polycarbonate resin and has an annular frame 61 that forms the outer circumferential edge and a partition 62 surrounded by the annular frame 61.

The annular frame 61 comprises a large diameter frame portion 63 formed at the back side of the annular frame 61, a small diameter frame portion 64 formed at the front side of the annular frame 61, a loop groove (a second loop groove) 65 formed around the small diameter frame portion 64, and an annular ridge 66 formed on the front surface of the small diameter frame portion 64. A fitting portion 67 for fitting the ribbon cable 11 is formed by cutting away portions of the large diameter frame portion 63, at locations intersecting an imaginary straight line that passes the center of the back surface of the base member 51. The annular frame 61 is also provided with a pair of base-side fastening portions 68 which are curved in an arc and protrude from the back end of the annular frame 61.

A pair of catching grooves 69 are formed overlapping the large diameter frame portion 63 and the small diameter frame portion 64 of the annular frame 61. Although the leading end 69*a* of each catching groove 69 is open at the front surface of the base member 51, the remaining part of the groove is open at the back end of the base member 51.

The partition 62 has a flat bottom 70 and a tapered surface 71 formed around the bottom 70. A window 72 elongated in the lateral direction as viewed in FIGS. 4 and 5 is formed at the center of the partition 62, between the aforementioned pair of fitting portions 67. A window frame portion 73 is formed on the back end of the window 72, around the outer edge thereof. A loop groove (a first loop groove) 74 is formed in the inner surface of the window frame portion 73.

Next, the back end member 52 is explained, referring to FIGS. 8 through 11.

Figure 8:
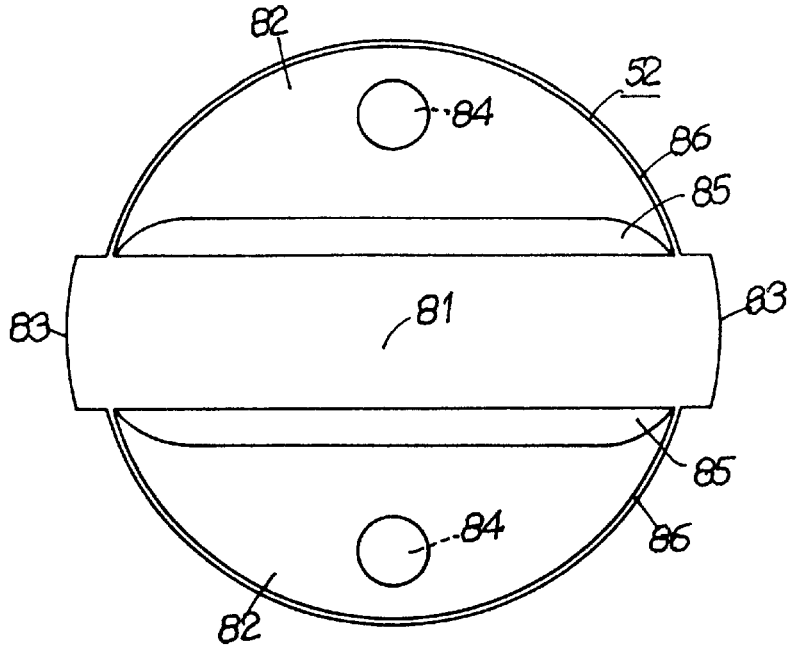
FIG. 8 is a front view of a back end member of said watertight cover mechanism.
Figure 9:
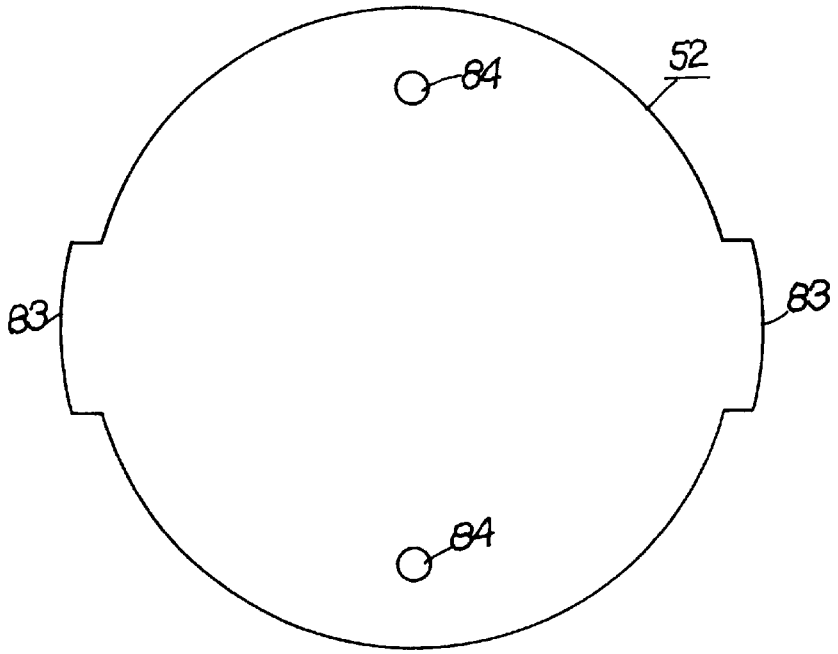
FIG. 9 is a back view of the back end member of the watertight cover mechanism.
Figure 10:
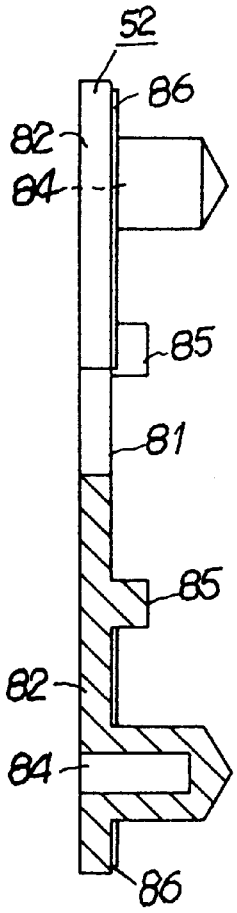
FIG. 10 is a partially sectional left side view of the back end member of the watertight cover mechanism.
Figure 11:
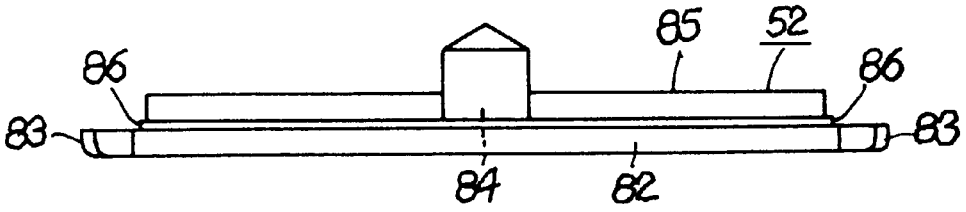
FIG. 11 is a bottom view of the back end member of the watertight cover mechanism.

FIG. 8 is a front view of the back end member 52 of the watertight cover mechanism 2; FIG. 9 is a back view of the back end member 52 of the watertight cover mechanism 2; FIG. 10 is a partially sectional left side view of the back end member 52 of the watertight cover mechanism 2; and FIG. 11 is a bottom view of the back end member 52 of the watertight cover mechanism 2.

The back end member 52 is formed in a generally disk-like shape by molding transparent polycarbonate resin. A seating portion 81 for receiving the ribbon cable 11 is formed at the center of the front surface of the back end member 52 and flanked by a pair of arc-shaped back-end-side fastening portions 82. Support portions 83 protruding outward are respectively formed at the two opposing ends of the seating portion 81, and a mounting hole 84 is formed behind each back-end-side fastening portion 82.

The seating portion 81 is formed by dividing the back end member 52 by means of a pair of ridges 85 that sandwich the seating portion 81.

An arc-shaped rib 86 is formed around the outer edge of each back-end-side fastening portion 82.

The support portions 83 protrude from the back end member 52 as an integral body therewith in order to support the ribbon cable 11, thereby preventing it from exerting an unfavorable influence on the sealing function of the first sealing member 54, when the ribbon cable 11 is bent.

An appropriate number of the aforementioned mounting holes 84 open at the back face of the back end member 52 may be formed between the rib 86 and the ridge 85 of each back-end-side fastening portion 82 in such a manner that each mounting hole 84 is adapted to receive a tapping screw therein.

Figure 12:
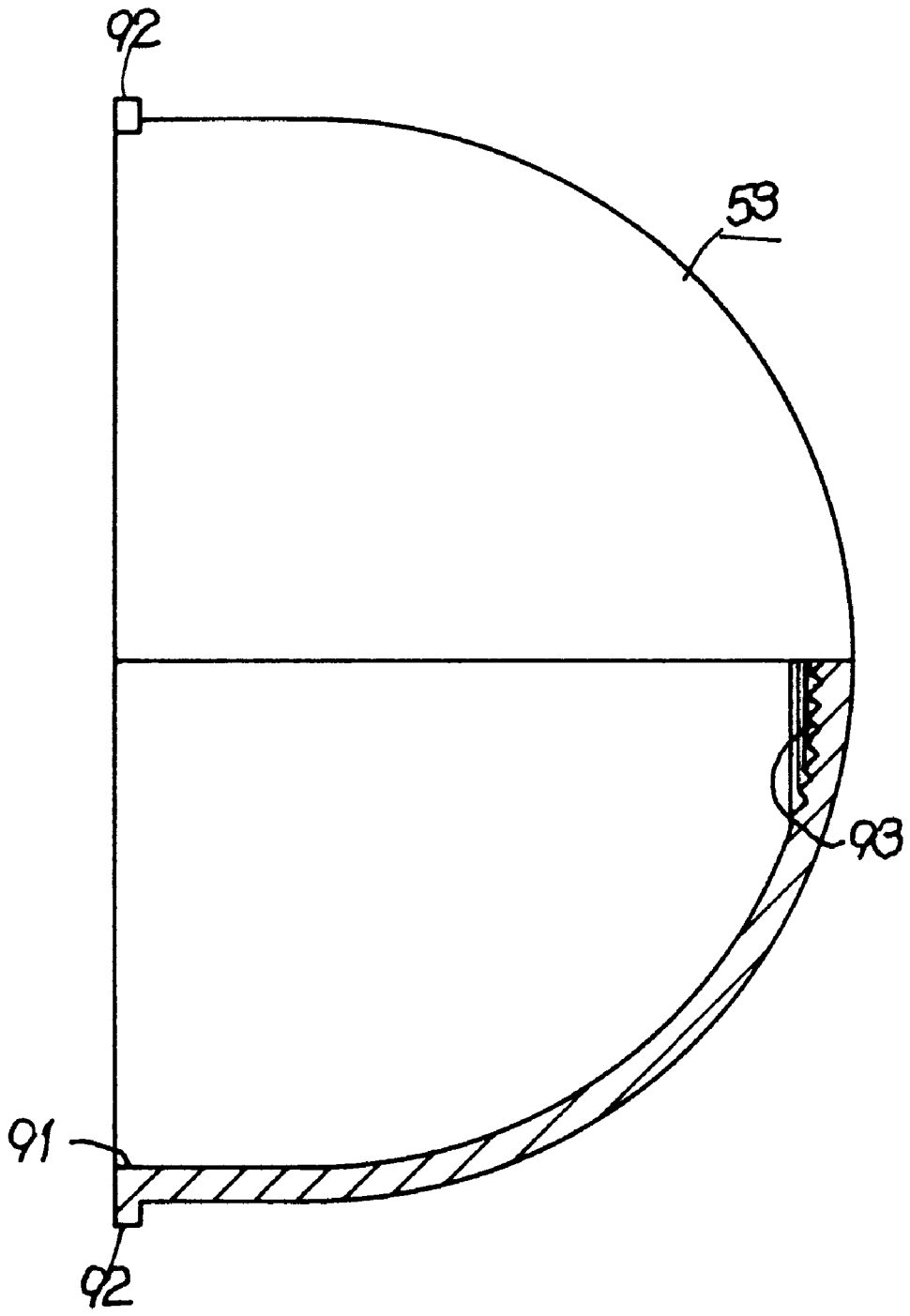
FIG. 12 is a partially sectional left side view of a translucent globe of the watertight cover mechanism.
Figure 13:
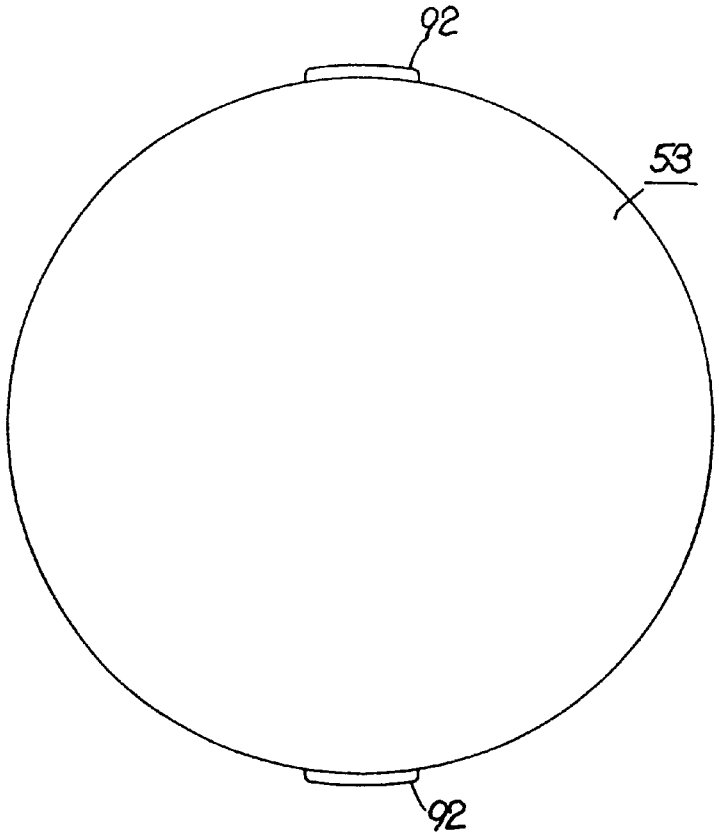
FIG. 13 is a top view of said translucent globe of the watertight cover mechanism.

Next, the translucent globe 53 is explained, referring to FIGS. 12 and 13.

FIG. 12 is a partially sectional left side view of the translucent globe 53 of the watertight cover mechanism 2, and FIG. 13 is a top view of the translucent globe 53 of the watertight cover mechanism 2.

The translucent globe 53 is formed by molding transparent polycarbonate resin into a generally hemi-spherical shape open at one end, which is a flat, circular end referred to as the open end 91. A pair of catching ridges 92 are formed on the outer wall of the open end 91 of the translucent globe 53, and concentrically arranged prisms 93 for adjusting the luminance are formed on the inner surface of the translucent globe 53, at the front end of the translucent globe 53.

Figure 14:
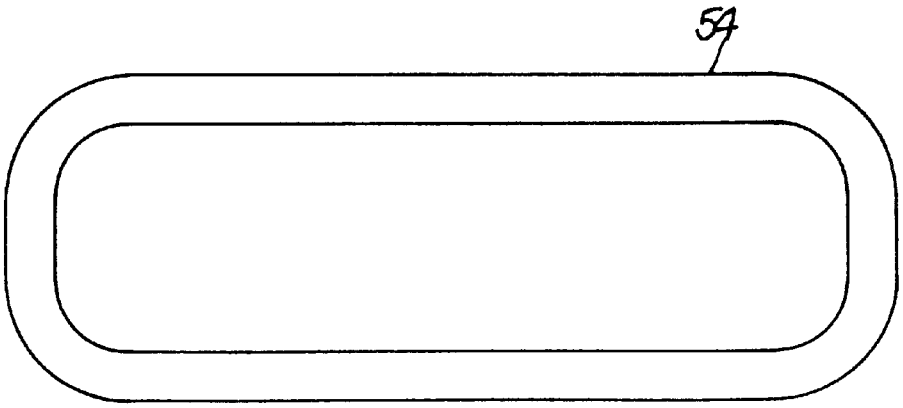
FIG. 14 is a front view of a first sealing member of the watertight cover mechanism.
Figure 15:
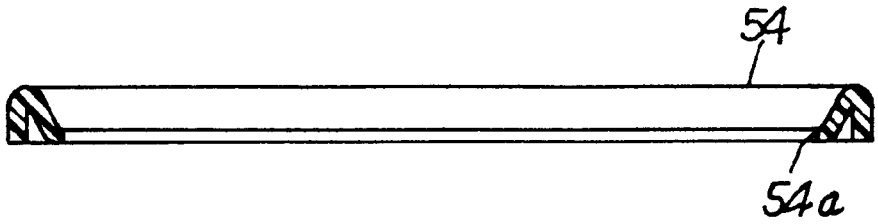
FIG. 15 is a transverse sectional view of said first sealing member.
Figure 16:
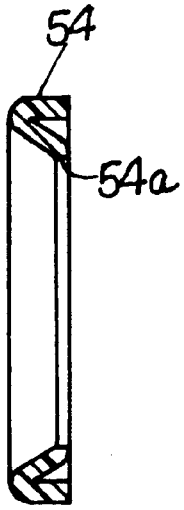
FIG. 16 is a vertical sectional view of said first sealing member.

Next, the first sealing member 54 is explained, referring to FIGS. 14 through 16.

FIG. 14 is a front view of the first sealing member 54 of the watertight cover mechanism 2; FIG. 15 is a transverse sectional view of the first sealing member 54 of the watertight cover mechanism 2; and FIG. 16 is a vertical sectional view of the first sealing member 54 of the watertight cover mechanism 2.

The first sealing member 54 is formed in a loop that has an approximately V-shaped cross section and such a shape and dimensions that enable the first sealing member 54 to come into close contact with the outer surface of the socket 12. The socket-facing end of the first sealing member 54 slightly protrude so as to serve as a contact edge 54*a*. The first sealing member 54 is adapted to be fitted in the loop groove 74 of the base member 51. The first sealing member 54 can be attached to the socket 12 and the base member 51 by fitting the first sealing member 54 around the outer surface of the socket 12 of the strip-mounted luminaire 1 and then inserting the socket 12 from the back end of the base member 51 into the window 72 so that the first sealing member 54 is snugly contained in the loop groove 74.

As shown in FIG. 2, the second sealing member 55 is an O-ring that is adapted to be fitted in the loop groove 65 of the base member 65 so as to seal and waterproof the gap between the inner surface of the translucent globe 53 and the loop groove 65.

The lighting fixture can be assembled as shown in FIG. 1 from the strip-mounted luminaire 1 and the watertight cover mechanism 2 by following the procedure described below.

First, in the state where the base member 51 is positioned inside out, the socket 12 of the strip-mounted luminaire 1 is inserted into the window 72 while the ribbon cable 11 is fitted in the fitting portions 67. As described above, the first sealing member 54 should be attached to the socket 12 beforehand.

Next, the seating portion 81 of the back end member 52 is brought into contact with the ribbon cable 11, and the ribs 86 of the back end member 52 is fastened to the base member 51 by conducting ultrasonic welding in the state where the two base-side fastening portions 68 of the base member 51 are in close contact with the back-end-side fastening portions 82 of the back end member 52.

After the strip-mounted luminaire 1, the base member 51 and the back end member 52 are turned to the original position, the illuminant 13 is mounted on the socket 12.

Finally, the open end 91 of the translucent globe 53 is fitted around the annular ridge 66 of the base member 51 from outside, and the translucent globe 53 is then rotated so that its catching edge 51 becomes fitted in the catching grooves 69 of the base member 51.

By following the procedure described above, the strip-mounted luminaire 1 and the watertight cover mechanism 2 are integrated and waterproofed. To be more specific, the space around the socket 12 is waterproofed by sealing with the first sealing member 54, while the open end 91 of the translucent globe 53 is watertightly sealed onto the base member 51 with the second sealing member 55.

Figure 17:
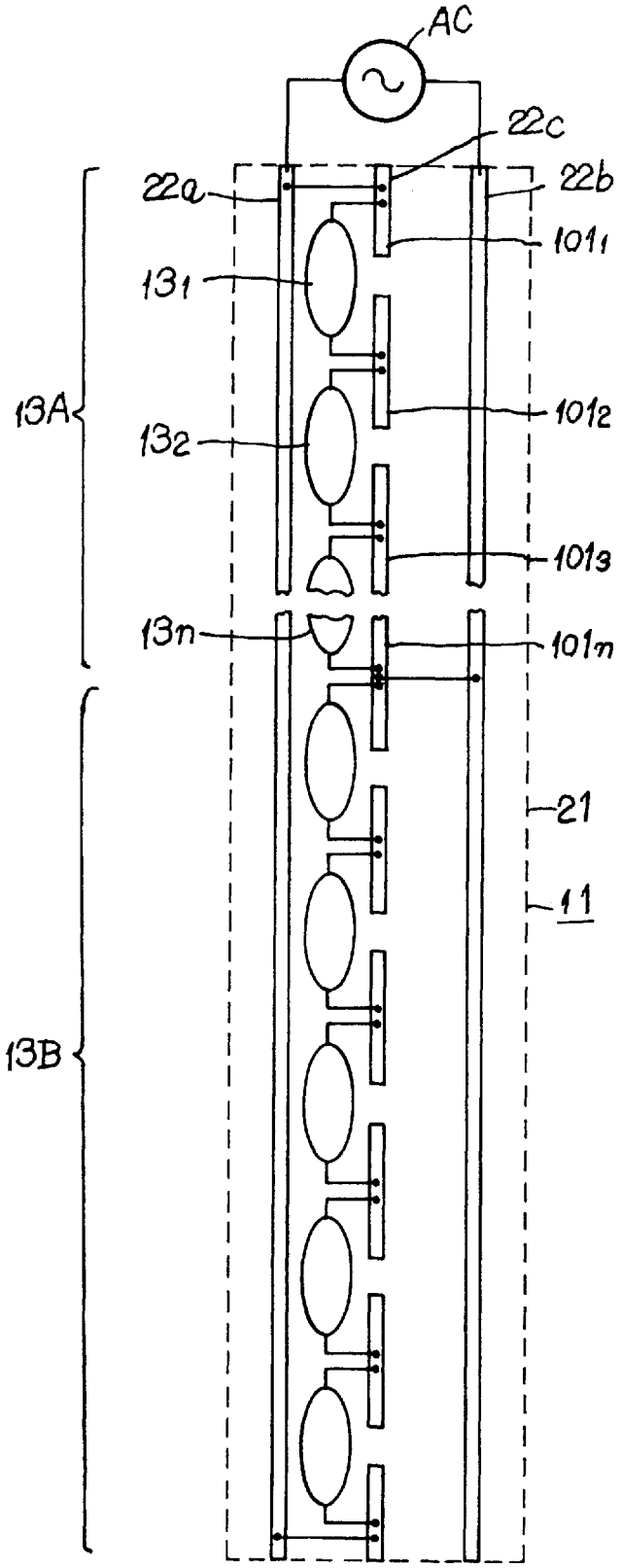
FIG. 17 is a circuit diagram of a lighting fixture which is provided with a strip-mounted luminaire according to a second embodiment of the present invention.
Figure 18:
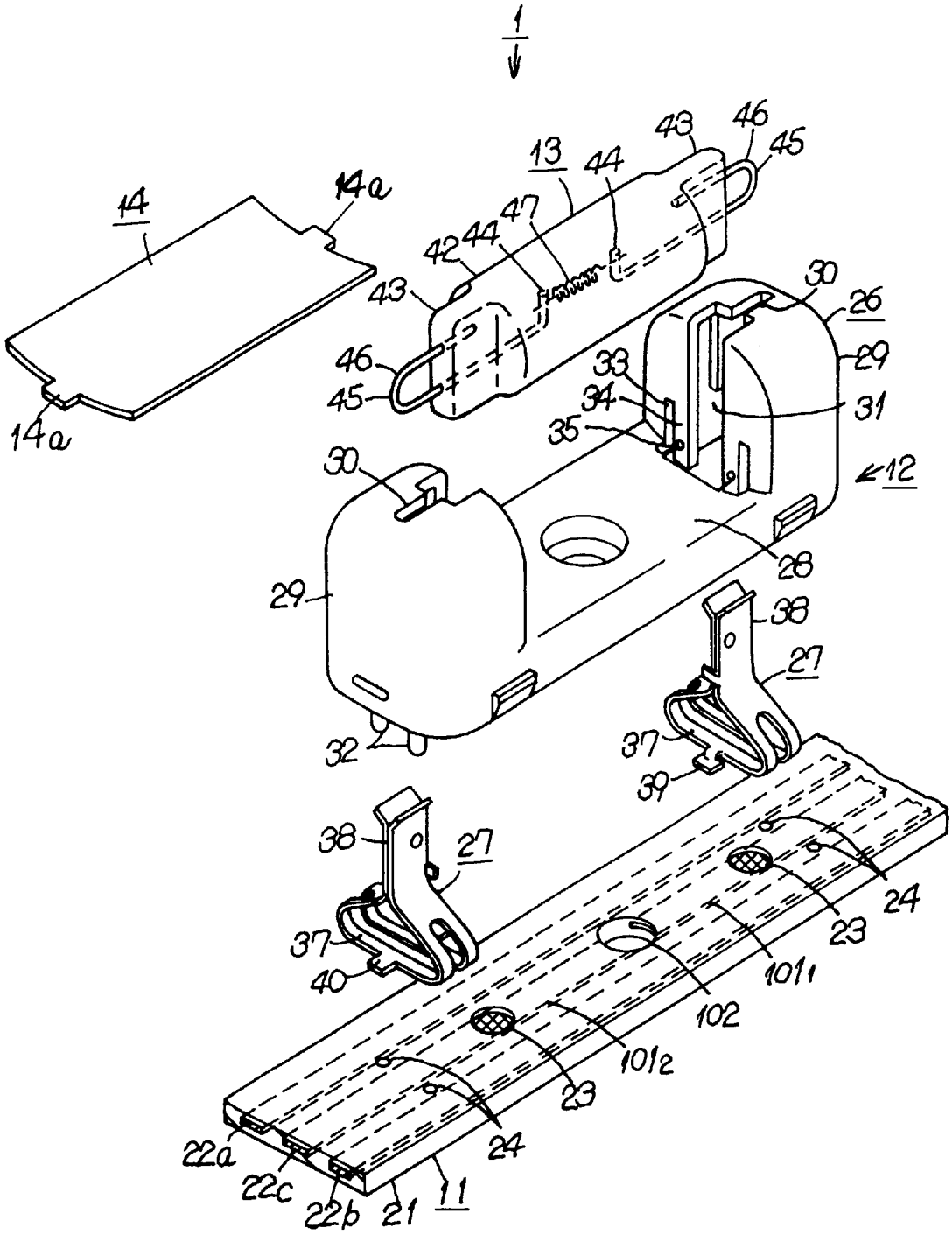
FIG. 18 is an exploded perspective view of said strip-mounted luminaire.

The second embodiment of the present invention is shown in FIGS. 17 and 18.

The elements having structures and functions similar to those of the first embodiment are referred to with the same reference numerals and their explanation is omitted in the following.

FIG. 17 is a circuit diagram of a lighting fixture having a strip-mounted luminaire 1.

The strip-mounted luminaire 1 according to the second embodiment is designed such that a voltage of 100 V ac is directly applied to the ribbon cable 11.

To be more specific, the ribbon cable 11 comprises three conductive members 22*a*,22*b*,22*c* and an insulating cover 21, in which the conductive members 22*a*,22*b*,22*c* are embedded. Of the thee conductive members, the two outer members, i.e. 22*a* and 22*b*, are designed to be directly connected to an ac power supply AC so as to receive a voltage of 100 V. The remaining conductive member 22*c* is divided into an appropriate number of conductive pieces $\mathbf{101}_1$, $\mathbf{101}_2$, . . . $\mathbf{101}_n$.

A plurality of illuminants 13, which are given reference numerals $\mathbf{13}_1$, $\mathbf{13}_2$, . . . $\mathbf{13}_n$ in order to distinguish them from one another, are connected in series via the conductive pieces $\mathbf{101}_1$, $\mathbf{101}_2$, . . . $\mathbf{101}_n$. Whereas the illuminant $\mathbf{13}_1$ at one end is connected to the conductive member 22*a* and the conductive piece $\mathbf{101}_1$, the illuminant $\mathbf{13}_2$ is connected to the conductive pieces $\mathbf{101}_1$ and the conductive piece $\mathbf{101}_2$. The illuminant $\mathbf{13}_n$ at the other end of the series is connected to the conductive pieces $\mathbf{101}_2$ and the conductive piece $\mathbf{101}_n$. The conductive piece $\mathbf{101}_n$ is also connected to the conductive member 22*b*.

Thus, the illuminants $\mathbf{13}_1$, $\mathbf{13}_2$, . . . $\mathbf{13}_n$ connected in series form an illuminant group 13A, which is connected to an ac power supply AC. A plurality of illuminant groups 13B . . . may be formed in the same manner as above. Each illuminant 13 may be of a light emitting element having a low rated voltage.

FIG. 18 is an exploded perspective of the strip-mounted luminaire.

Through holes 102 are bored through the insulating cover 21 and the conductive member 22*c* of the ribbon cable 11 in order to divide the conductive member 22*c* into segments. After the conductive member 22*c* is divided into segments, an insulating treatment is conducted by filling the through holes 102 with silicone.

One of the contact pieces 27 of the socket 12 is connected to the conductive piece $\mathbf{101}_1$, and the other contact pieces 27 is connected to the conductive piece $\mathbf{101}_2$.

Figure 19:
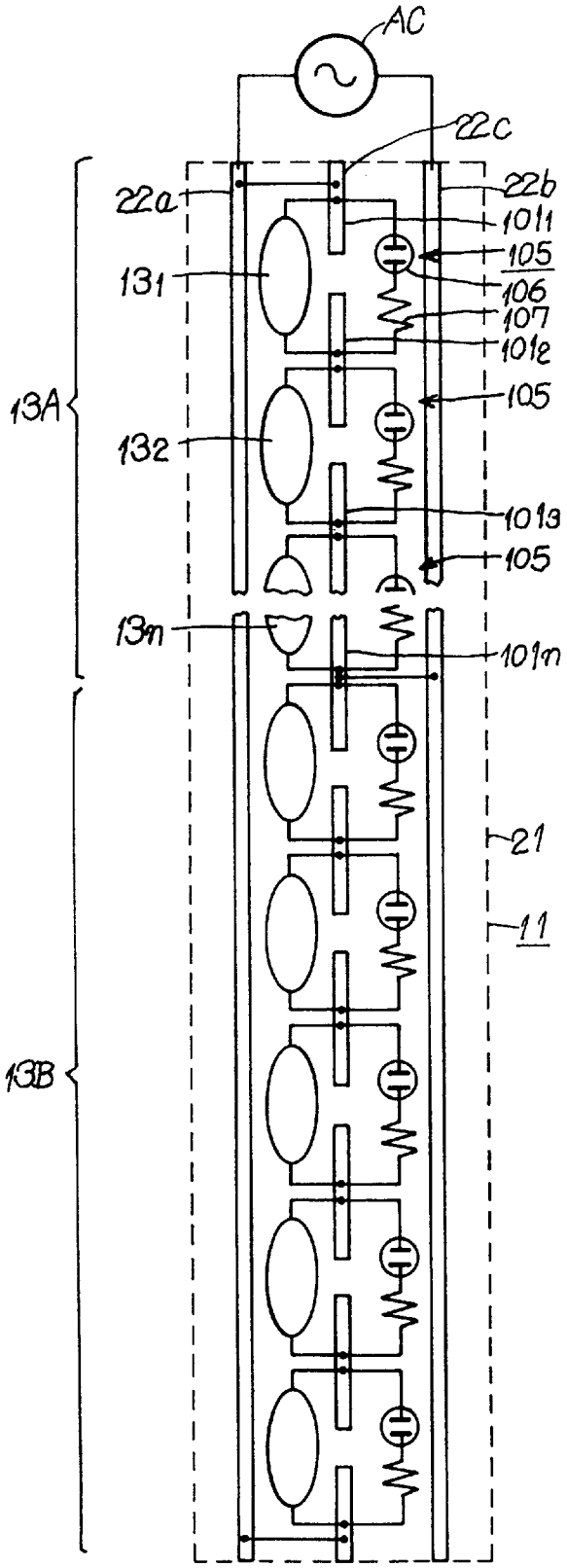
FIG. 19 is a circuit diagram of a lighting fixture which is provided with a strip-mounted luminaire according to a third embodiment of the present invention.

Next, the third embodiment is explained, referring to FIG. 19.

The elements having structures and functions similar to those of the embodiments described above are referred to with the same reference numerals and their explanation is omitted in the following.

In case one or more illuminants 13 in an illuminant group 13A,13B, . . . fail to be lit due to breakage of the filament(s) or other causes so that the circuit is closed, all the illuminants 13 that belong to the illuminant group 13A,13B, . . . in question fail to be lit, making it difficult to discern the defective illuminant(s) 13. In order to solve this problem, an feature of the third embodiment lies in the function to indicate such defective illuminants 13; a display means adapted to be actuated when a full source voltage is applied due to failure in lighting of an illuminant is connected in parallel with each illuminant 13.

Each display means 105 consists of a glow discharge lamp 106 and a current limiting resistor 107 connected in series with the glow discharge lamp 106. Even if one or more illuminants 13 in an illuminant group 13A,13B, . . . connected in series fail to be lit due to breakage of the filament(s), thereby closing the circuit, the other illuminants 13 belonging to the illuminant group 13A,13B, . . . remain lit, and the glow discharge lamp(s) 106 connected in parallel with the illuminant(s) 13 that has or have failed to be lit become lit, thereby indicating the defective illuminant(s) 13. Each display means 105 should be disposed at a location easily seen from outside.

Figure 20:
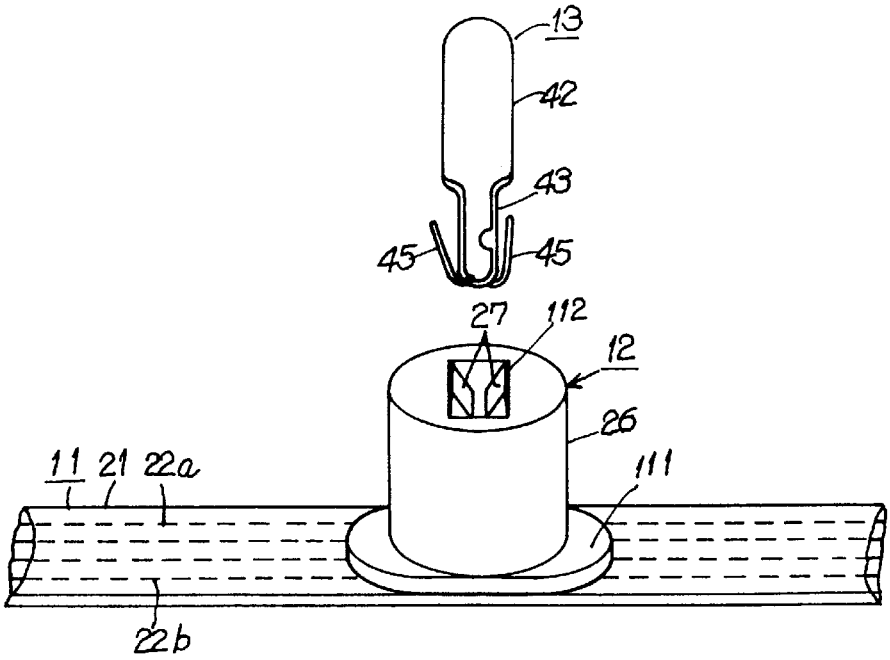
FIG. 20 is an exploded perspective view of a strip-mounted luminaire according to a fourth embodiment of the present invention.

Next, the fourth embodiment is explained, referring to FIG. 20.

The elements having structures and functions similar to those of the embodiments described above are referred to with the same reference numerals and their explanation is omitted in the following.

FIG. 20 is an exploded perspective view of the strip-mounted luminaire.

The fourth embodiment is different from the embodiments described above in the configurations of the socket 12 and the illuminants 13.

Each illuminant 13 is a light bulb having a single, wedge-shaped base.

The socket body 26 of a socket 12 is made of an insulating material and provided with a flange 111 formed in the shape of an elongated circle and a light bulb insertion hole 112 in which an illuminant 13 is adapted to be fitted in a position such that it faces up. The flange 111 is formed at the portion where the socket body 26 will be in contact with the ribbon cable 11, while the light bulb insertion hole 112 is formed at the upper end of the socket body 26. A pair of contact pieces 27 adapted to be connected to the illuminant 13 are housed in the light bulb insertion hole 112 of the socket body 26.

A watertight cover mechanism 2 can be arranged to fit the socket 12 of the fourth embodiment simply by so designing the first sealing member 54 of the base member 51 shown in FIG. 1 as to come into contact with the flange 111.

Figure 21:
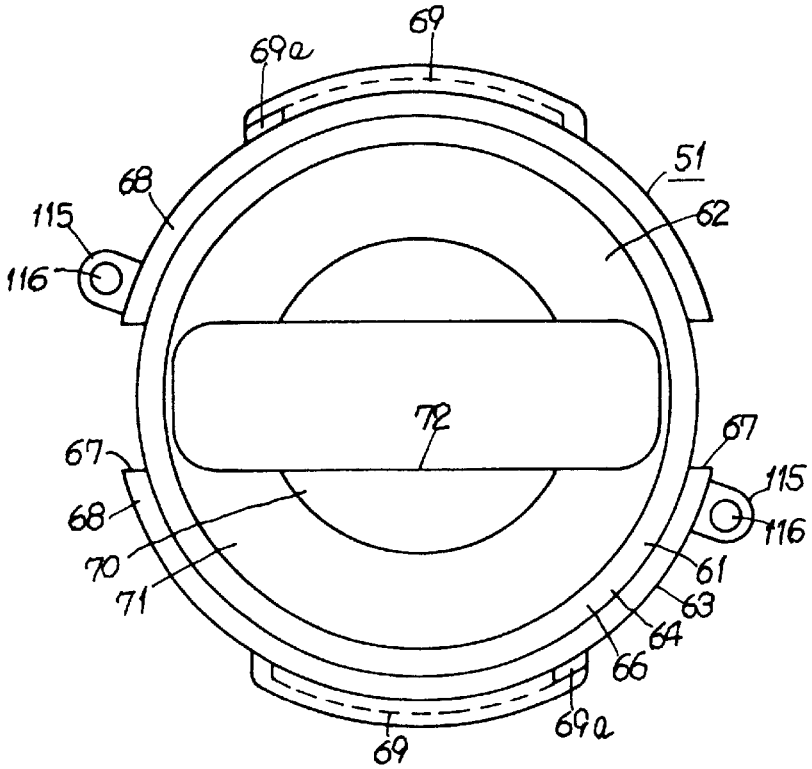
FIG. 21 is a front view of a base member of a watertight cover mechanism according to a fifth embodiment of the present invention.

Next, the fifth embodiment is explained, referring to FIG. 21.

The elements having structures and functions similar to those of the embodiments described above are referred to with the same reference numerals and their explanation is omitted in the following.

FIG. 21 is a front view of the base member 51 of the watertight cover mechanism 2.

According to the fifth embodiment, a pair of mounting tabs 115 serving as a fastening means are formed on the annular frame 61 of the base member 51 of the watertight cover mechanism 2 as an integral body with the annular frame 61. The two mounting tabs 115 are located on an imaginary diagonal line and project outwards, in opposite directions, along said diagonal line. A mounting hole 116 is formed in each mounting tab 115.

By using mounting tabs 115, the base member 51 can easily be mounted at a desired location of a building (or a structure) 3 from the front side of the watertight cover mechanism 2.

Figure 22:
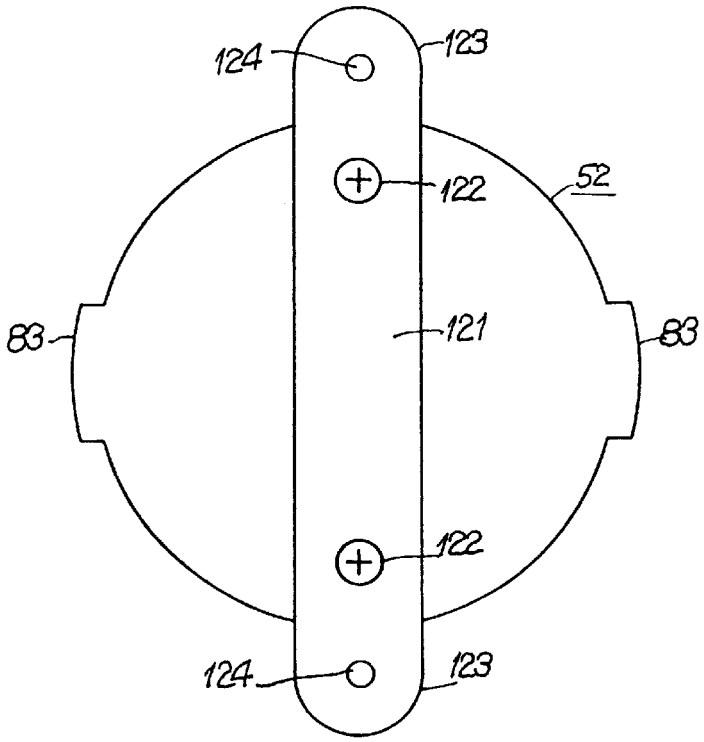
FIG. 22 is a back view of a back end member of a watertight cover mechanism according to a sixth embodiment of the present invention.

Next, the sixth embodiment is explained, referring to FIG. 22.

The elements having structures and functions similar to those of the embodiments described above are referred to with the same reference numerals and their explanation is omitted in the following.

FIG. 22 is a back view of the back end member 52 of the watertight cover mechanism 2.

The feature of the sixth embodiment lies in that the watertight cover mechanism 2 can be mounted on a building (or a structure) 3 from the front side of the watertight cover mechanism 2 by using mounting holes 84 formed in the back end member 52. To be more specific, a mounting stay 121 which is in the shape of a flat plate and used as an adapter as well as a fastening means is attached to the back end member 52 with screws 122 screwed in the mounting holes 84 of the back end member 52. A mounting portion 123 is formed at each end of the mounting stay 121 and projects from the side edge of the back end member 52. A mounting hole 124 is formed in each mounting portion 123.

With the configuration as above, by using the mounting stay 121, the base member 51 can easily be mounted at a desired location of a building (or a structure) 3 from the front side of the watertight cover mechanism 2.

Figure 23:
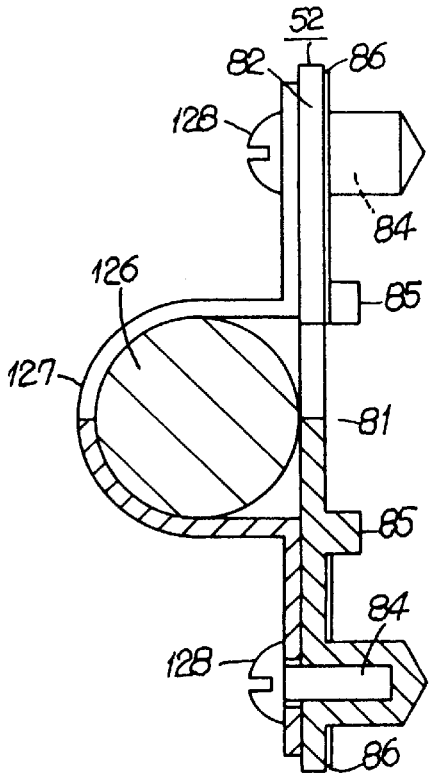
FIG. 23 is a partially sectional left side view of a back end member of a watertight cover mechanism according to a seventh embodiment of the present invention.

Next, the seventh embodiment is explained, referring to FIG. 23.

The elements having structures and functions similar to those of the embodiments described above are referred to with the same reference numerals and their explanation is omitted in the following.

FIG. 23 is a partially sectional left side view of the back end member 52 of the watertight cover mechanism 2.

The feature of the seventh embodiment lies in that a luminaire can be attached to a cord-shaped member 126, such as a wire, by means of the mounting holes 84 of the back end member 52. To be more specific, the two opposing ends of a mounting saddle 127, which serves as a cord-shaped member adapter for embracing the cord-shaped member 126, are attached to the back end member 52 with screws 128 that are screwed in the mounting holes 84 of the back end member 52.

By thus using the mounting saddle 127, a luminaire can easily be attached to the cord-shaped member 126.

Next, the eighth embodiment is explained, referring to FIGS. 24 through 41.

The elements having structures and functions similar to those of the embodiments described above are referred to with the same reference numerals and their explanation is omitted in the following.

Figure 24:
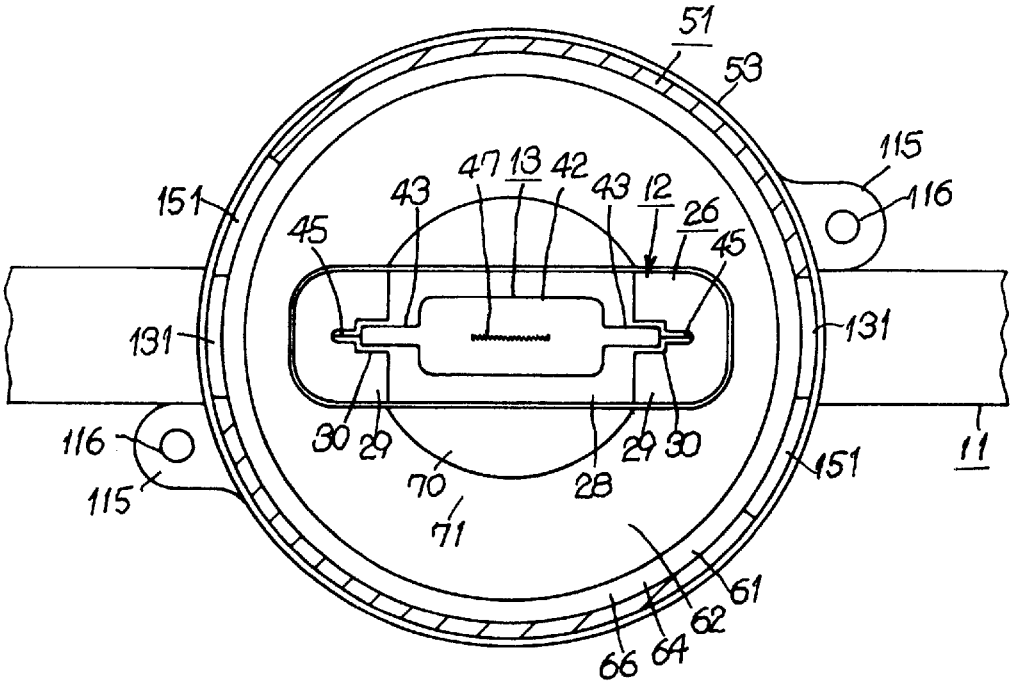
FIG. 24 is a front view of a lighting fixture which is provided with a strip-mounted luminaire and a watertight cover mechanism according to an eighth embodiment of the present invention, shown in the state where the translucent globe is removed.
Figure 25:
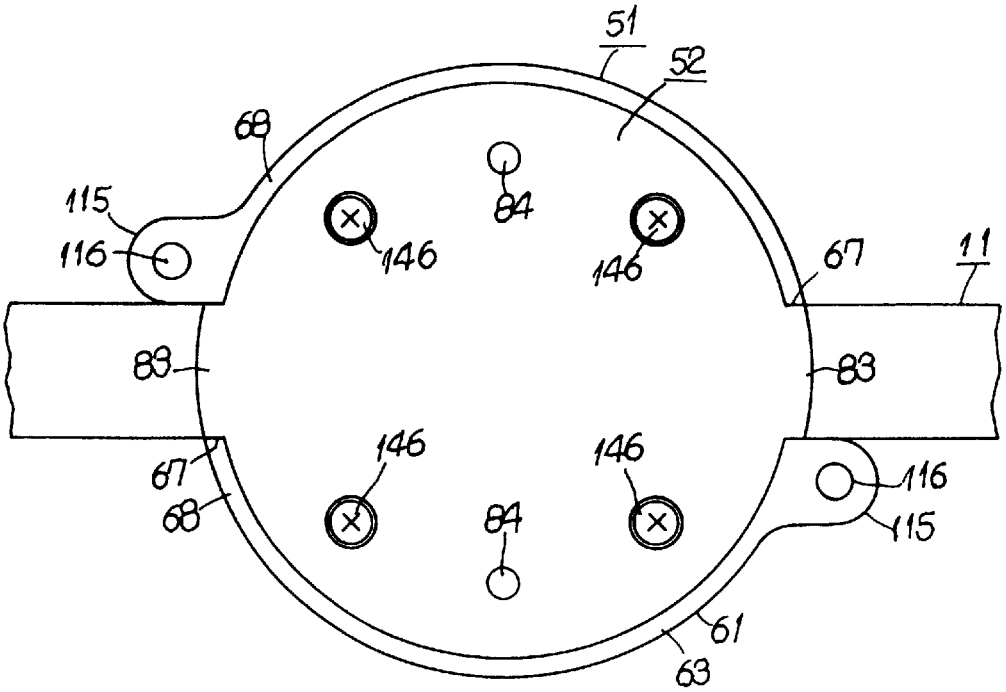
FIG. 25 is a back view of said lighting fixture.
Figure 26:
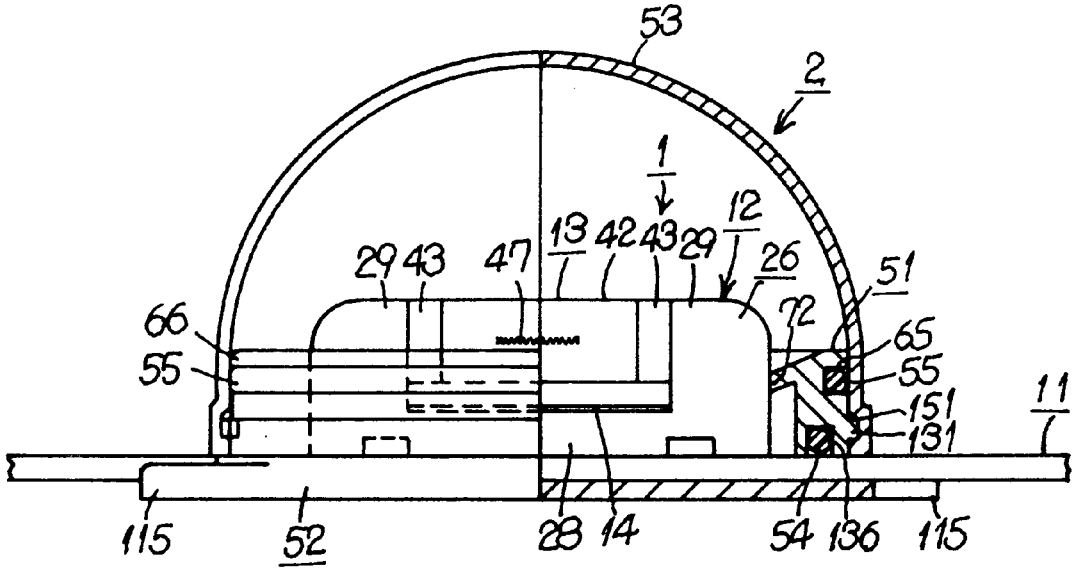
FIG. 26 is a partially sectional bottom view of said lighting fixture.
Figure 27:
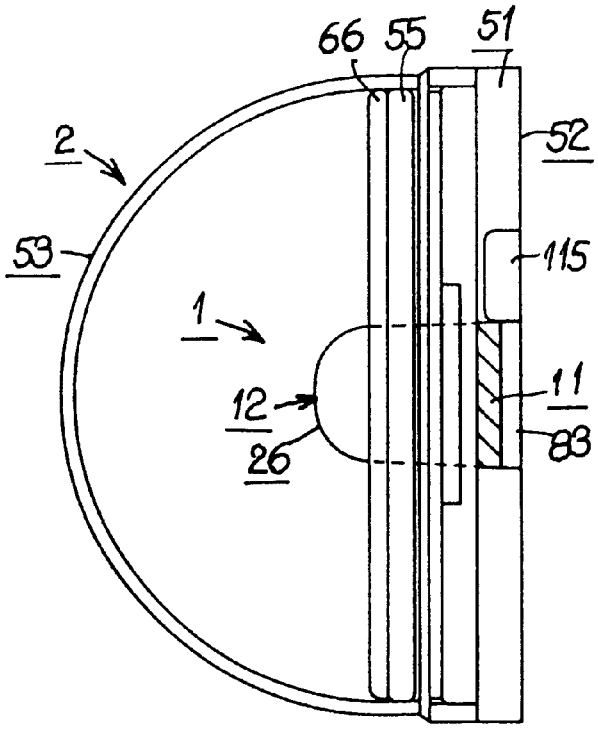
FIG. 27 is a left side view of said lighting fixture.
Figure 28:
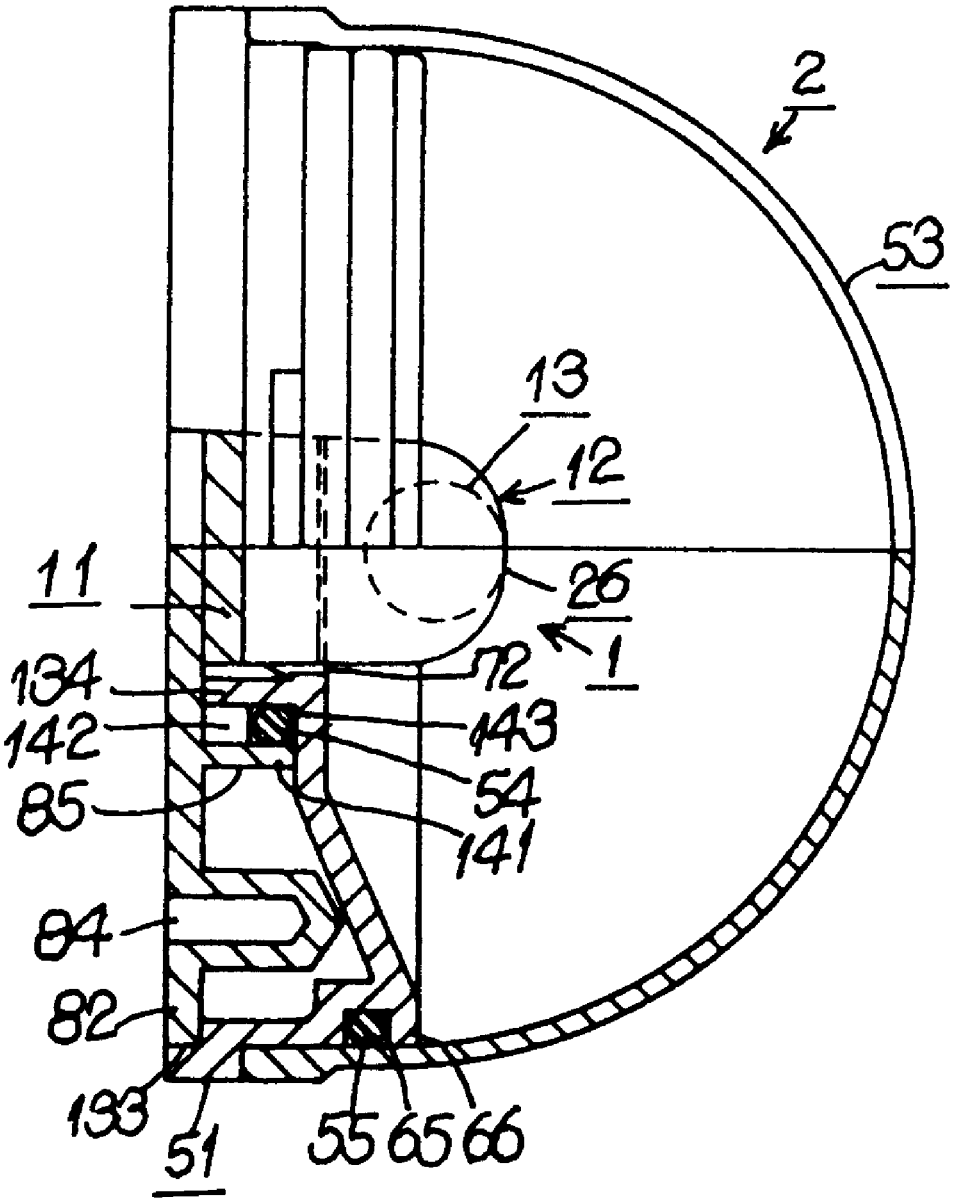
FIG. 28 is a partially sectional right side view of the lighting fixture.

FIG. 24 is a front view of a luminaire which is provided with a strip-mounted luminaire 1 and a watertight cover mechanism 2, shown in the state where the translucent globe 53 is removed; FIG. 25 is a back view of the luminaire; FIG. 26 is a partially sectional bottom view of the luminaire; FIG. 27 is a left side view of the luminaire; and FIG. 28 is a partially sectional right side view of the luminaire.

The eighth embodiment is different from the first embodiment primarily in the mechanism of attaching the watertight cover mechanism 2 and the translucent globe 53 around the socket 12.

The following is the detailed explanation of these components.

First, the base member 51 is explained.

Figure 29:
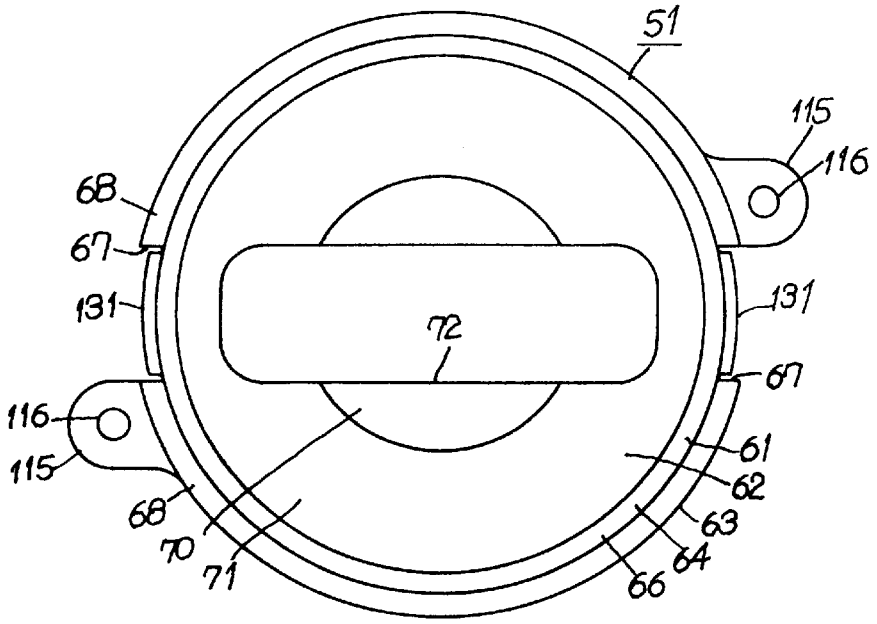
FIG. 29 is a front view of the base member of said watertight cover mechanism.
Figure 30:
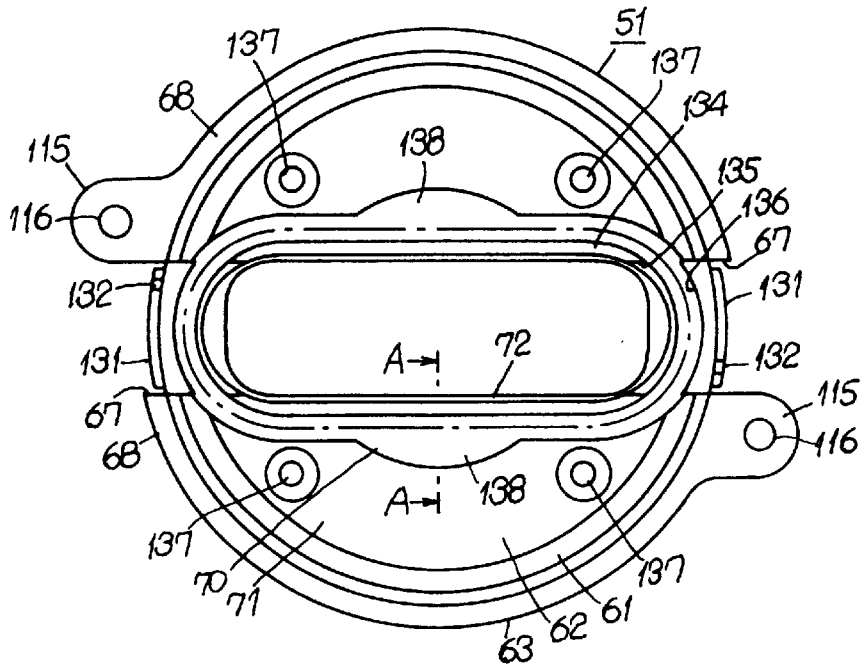
FIG. 30 is a back view of said base member of the watertight cover mechanism.
Figure 31:
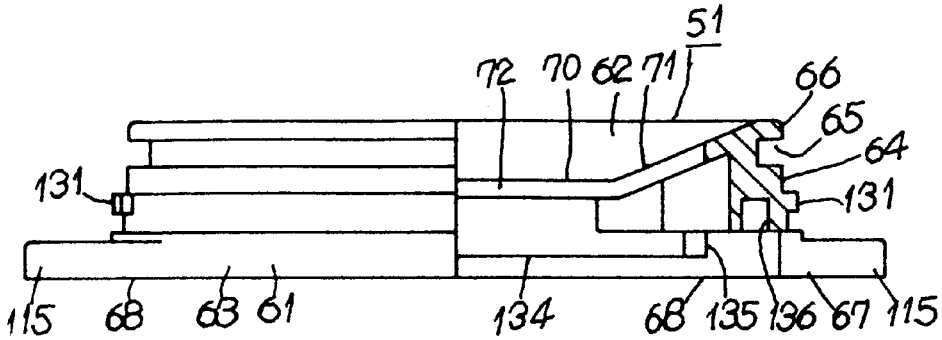
FIG. 31 is a partially sectional bottom view of the base member of the watertight cover mechanism.
Figure 32:
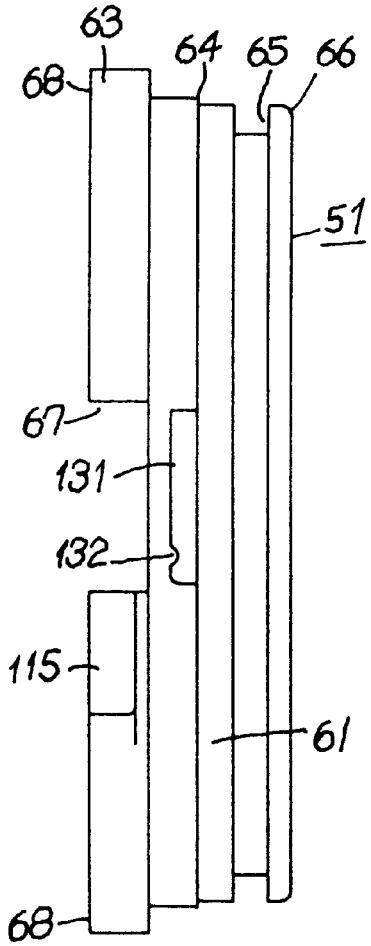
FIG. 32 is a left side view of said base member of the watertight cover mechanism.
Figure 33:
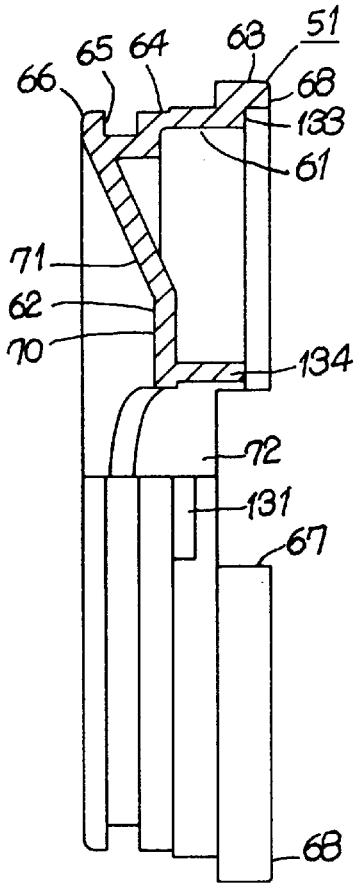
FIG. 33 is a partially sectional right side view of the base member of the watertight cover mechanism.
Figure 34:
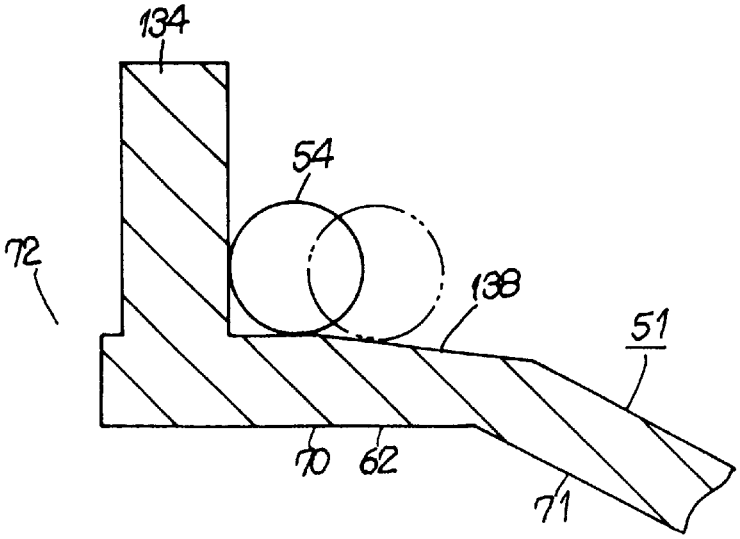
FIG. 34 is an enlarged sectional view of same, showing the part taken along the line A—A of FIG. 30.

FIG. 29 is a front view of the base member 51 of the watertight cover mechanism 2; FIG. 30 is a back view of the base member 51 of the watertight cover mechanism 2; FIG. 31 is a partially sectional bottom view of the base member 51 of the watertight cover mechanism 2; FIG. 32 is a left side view of the base member 51 of the watertight cover mechanism 2; FIG. 33 is a partially sectional right side view of the base member 51 of the watertight cover mechanism 2; and FIG. 34 is an enlarged sectional view of same, showing the part taken along the line A—A of FIG. 30 together with the first sealing member 54.

The base member 51 is formed in a generally disk-like shape by molding transparent polycarbonate resin and provided with arc-shaped catching lips 131 and mounting tabs 115. The catching lips 131 are formed on the outer circumferential surface of the annular frame 61, at locations closer to the front end than are the respective fitting portions 67 corresponding thereto, and the mounting tabs 115 are formed at locations respectively adjacent to the fitting portions 67. A stopper groove 132 is formed in the back face of each catching lip 131. As shown in FIG. 33, a fitting step 133 adapted to fit the base member 51 to the back end member 52 is formed on the back face of the base member 51, at the portion where the annular frame 61 is located.

As shown in FIGS. 30 and 31, a loop ridge 134 surrounding the window 72 with a slight distance therebetween is formed on the back face of the base member 51. The loop ridge 134 is interrupted at cutout portions 135, which are formed by cutting away the portions of the loop ridge 134 respectively facing the fitting portions 67. A groove 136 is formed outside each cutout portion 135. The first sealing member 54 is placed on the base member 51, at such a location as to cover the outer face of the loop ridge 134 and the grooves 136 facing the fitting portions 67. The one-dot chain line in FIG. 30 represents the central line of the first sealing member 54.

The second sealing member 55 is fitted in the loop groove 65 formed in the outer face of the annular ridge 66.

Referring to FIG. 30, two tapping screw holes 137 are formed at each side (each vertical side as viewed in FIG. 30) of the laterally elongated window 72. Furthermore, an inner pressure releasing portion 138 is formed at each side (each vertical side as viewed in FIG. 30) of the loop ridge 134.

As shown in FIG. 34, each inner pressure releasing portion 138 is located on the back end of the base member 51 and formed of a slanted surface adjacent to the flat face portion that is located adjacent to the loop ridge 134 and adapted to permit the first sealing member 54 to come into contact therewith. The function of the inner pressure releasing portions 138 is as follows: as shown in FIGS. 24 and 26, when actuated to emit light, the illuminant 13 generates heat; when the pressure in the translucent globe 53 exceeds a given value resulting from the generation of heat, the first sealing member 54, particularly the portion corresponding to the inner pressure releasing portions 138, is forced to move, against the resilience of the first sealing member 54, outward to the position represented by the two-dot chain line in FIG. 34. As a result, a minute gap is formed between the first sealing member 54 and each inner pressure releasing portion 138 and releases the expanded air to the outside, thereby balancing the pressures outside and inside the translucent globe 53. When the pressures are balanced, the elasticity of the first sealing member 54 returns the first sealing member 54 to its original position, where the first sealing member 54 performs its sealing function.

Therefore, even if the pressure in the translucent globe 53 is reduced when the light is put out, there is no danger of moisture or contaminants entering the translucent globe 53.

Next, the back end member 52 is explained.

Figure 35:
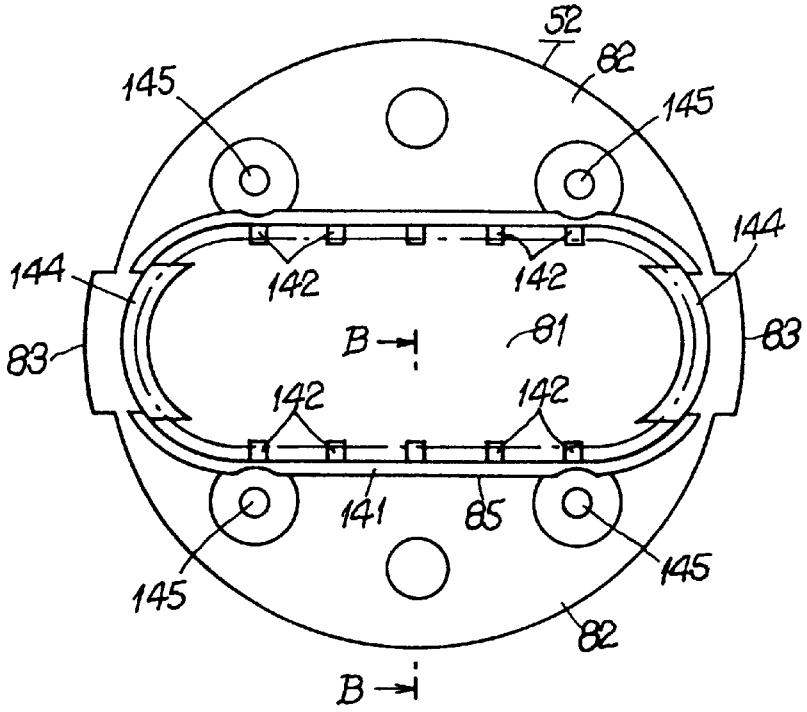
FIG. 35 is a front view of a back end member of said watertight cover mechanism.
Figure 36:
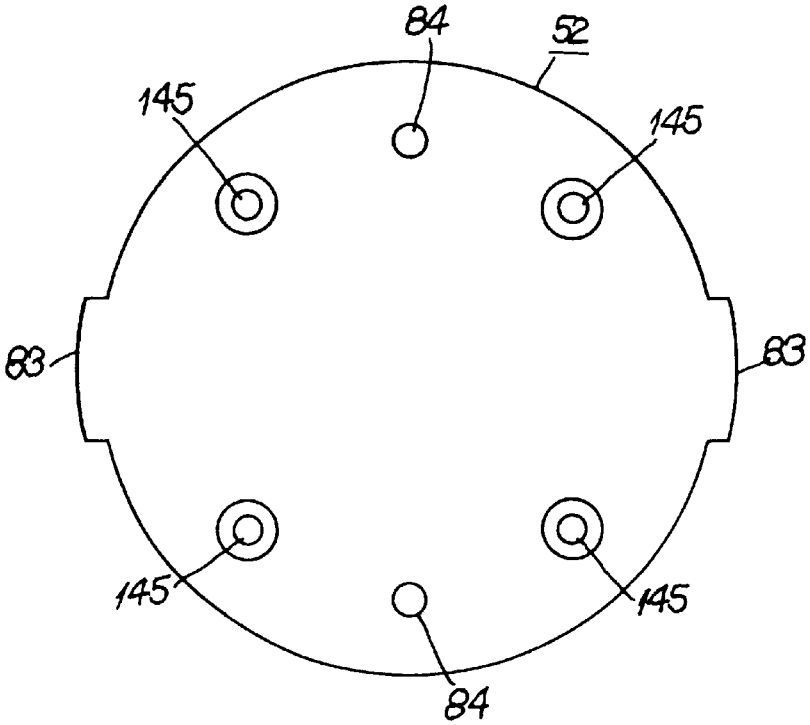
FIG. 36 is a back view of said back end member of the watertight cover mechanism.
Figure 37:
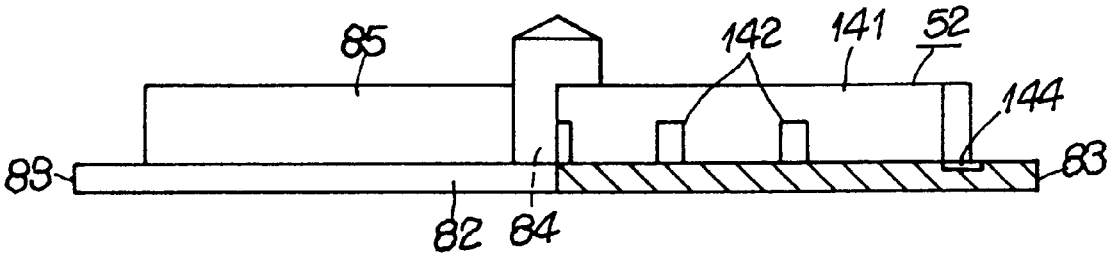
FIG. 37 is a partially sectional bottom view of the back end member of the watertight cover mechanism.
Figure 38:
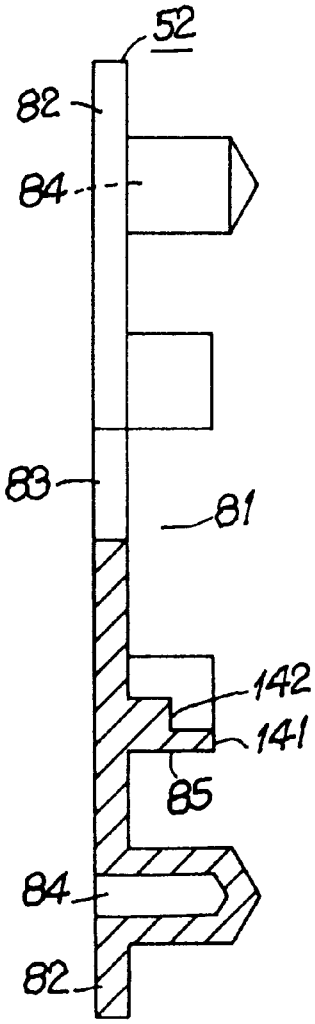
FIG. 38 is a left side view of said back end member of the watertight cover mechanism, showing the part along the line B—B of FIG. 35 in section.

FIG. 35 is a front view of the back end member 52 of the watertight cover mechanism 2; FIG. 36 is a back view of the back end member 52 of the watertight cover mechanism 2; FIG. 37 is a partially sectional bottom view of the back end member 52 of the watertight cover mechanism 2; and FIG. 38 is a left side view of the back end member 52 of the watertight cover mechanism 2, showing the part along the line B—B of FIG. 35 in section.

The back end member 52 is formed in a generally disk-like shape by molding transparent polycarbonate resin and adapted to be fitted to the fitting step 133 formed on the back end of the base member 51.

The back end member 52 is provided with a ridge portion 141 and a push portion 142 between the seating portion 81 and the back-end-side fastening portions 82, which flank the seating portion 81. As shown in FIG. 28, the ridge portion 141 is so formed as to face the loop ridge 134 at a distance so that the ridge portion 141 and the loop ridge 134 together form a groove 143, which serves to receive the first sealing member 54 therein. The one-dot chain line in FIG. 35 represents the central line of the first sealing member 54. The push portion 142 is formed at a location facing the groove 143 and divided into a plurality of parts.

A shallow groove portion 144 extending along the one-dot chain line in FIG. 35 is formed at a location corresponding to each support portion 83. These groove portions 144 serve as a reservoir of a sealing agent, such as silicone. Therefore, the back of the ribbon cable 11 can be sealed onto the back end face 52 with a sealing agent or the like.

Each back-end-side fastening portion 82 is provided with two threaded insertion holes 145 so that the base member 51 and the back end member 52 can tightly be fastened together by screwing tapping screws 146 through the threaded insertion holes 145 of the back end member 52 into the tapping screw holes 137 of the base member 51.

Therefore, in order to seal and waterproof the space around the socket 12, the first sealing member 54 formed of an O-ring is fitted around the loop ridge 134 formed on the back face of the base member 51, while the second sealing member 55, which is also formed of an O-ring, is fitted in the loop groove 65 of the annular ridge 66. Then, the socket 12 of the strip-mounted luminaire 1 is inserted from the back of the base member 51 into the window 72 of the base member 51. Thereafter, the groove portions 144 of the back end member 52 are filled with silicone resin, and the back end member 52 is fitted to the fitting step 133 on the back end of the base member 51, with the support portions 83 aligning with the fitting portions 67 of the base member 51. At that time, the socket seating portion 81 of the back end member 52 comes into contact with the back end of the socket 12, while the back-end-side fastening portions 82 snugly abut against the base-side fastening portions 68. In this state, the ridge portion 141 of the back end member 52 and the loop ridge 134 of the base member 51 face each other with a short distance therebetween, thereby forming a groove 143 for containing the first sealing member 54. Meanwhile, the push portion 142 pushes the first sealing member 54 into the groove 143. Finally, by inserting the tapping screws 146 through the threaded insertion holes 145 of the back end member 52 into the tapping screw holes 137 of the base member 51, the space around the socket 12 is watertightly sealed with the first sealing member 54 in the state where the socket 12 of the strip-mounted luminaire 1 is sandwiched, together with the ribbon cable 11, between the base member 51 and the back end member 52.

Next, the translucent globe 53 is explained hereunder.

Figure 39:
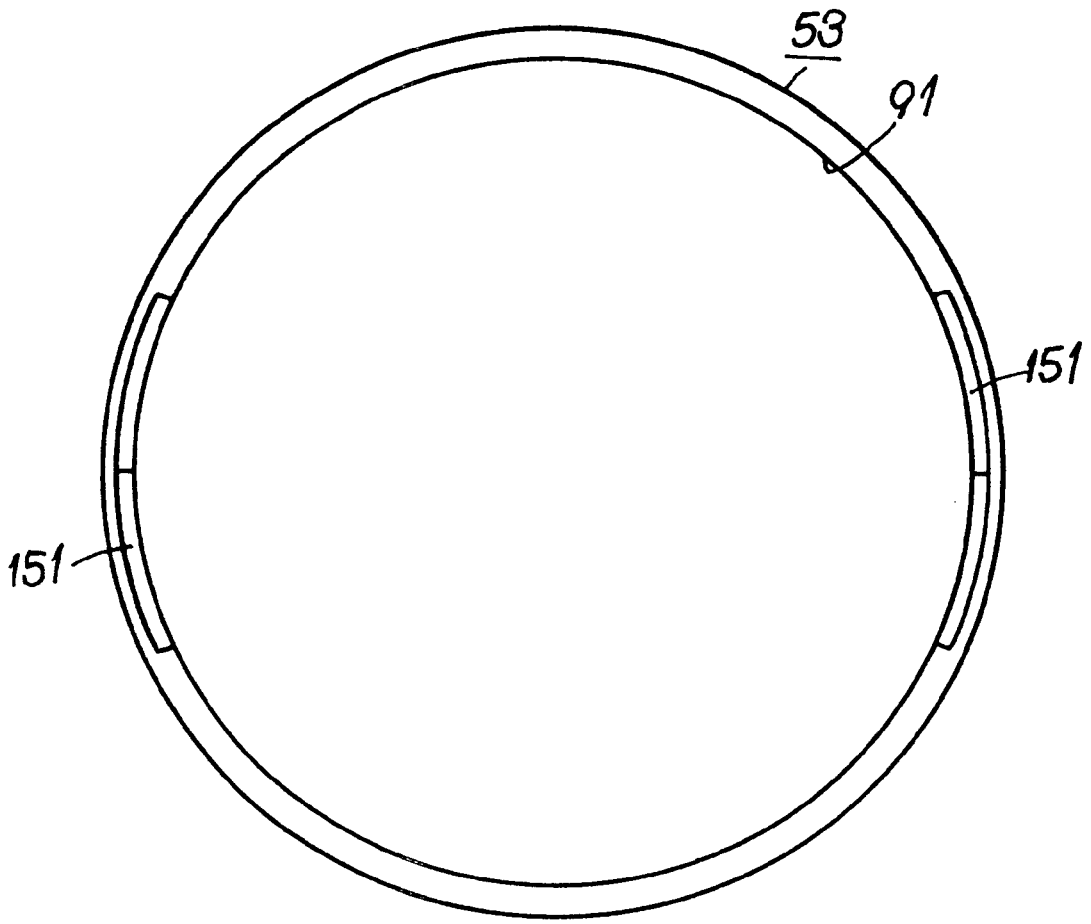
FIG. 39 is a back view of a translucent globe of said watertight cover mechanism.
Figure 40:
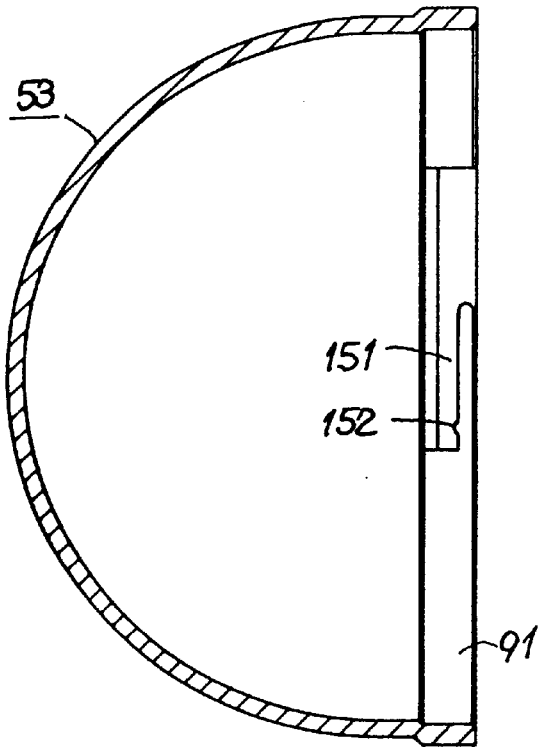
FIG. 40 is a sectional right side view of the translucent globe of the watertight cover mechanism.
Figure 41:
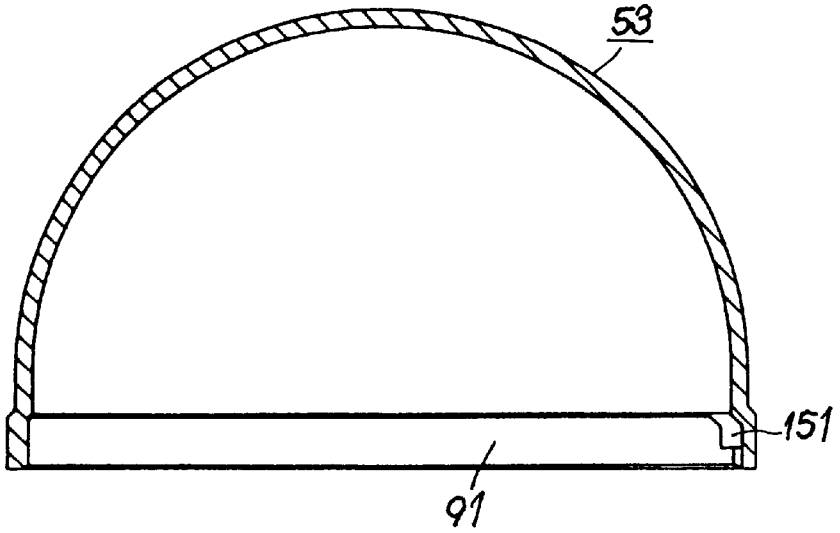
FIG. 41 is a sectional bottom view of the translucent globe of the watertight cover mechanism.

FIG. 39 is a back view of the translucent globe 53 of the watertight cover mechanism 2; FIG. 40 is a sectional right side view of the translucent globe 53 of the watertight cover mechanism 2; and FIG. 41 is a sectional bottom view of the translucent globe 53 of the watertight cover mechanism 2.

A pair of catching grooves 151 are formed in the inner wall of the open end 91 of the translucent globe 53, and a stopper protrusion 152 is formed in each catching groove 151.

The translucent globe 53 is designed such that each catching groove 151 of the translucent globe 53 can be engaged with the corresponding catching lip 131 of the base member 51 by fitting and rotating the open end 91 of the translucent globe 53 over the annular ridge 66 in the state where each catching groove 151 is positioned at the corresponding catching lip 131. As the translucent globe 53 is attached to the base member 51 with the stopper protrusions 152 of the catching grooves 151 engaged in the stopper grooves 132 of the catching lips 131, the translucent globe 53 will not easily be displaced from the base member 51.

When the translucent globe 53 is attached, the inner edge of the open end 91 of the translucent globe 53 comes into close contact with the second sealing member 55 fitted in the loop groove 65, which is formed around the outer surface of the annular ridge 66 of the base member 51, and the gap between the translucent globe 53 and the base member 51 is sealed and waterproofed.

Thus, the socket 12 of the strip-mounted luminaire 1 can be sealed and waterproofed together with the ribbon cable 11 by means of the first and second sealing members 54,55.

Figure 42:
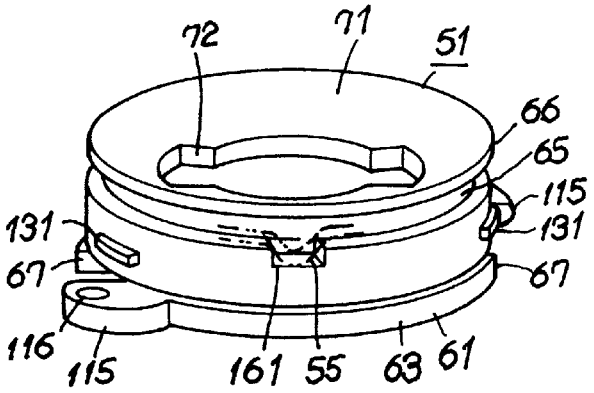
FIG. 42 is a perspective view of a base member of a watertight cover mechanism according to a ninth embodiment of the invention.
Figure 43:
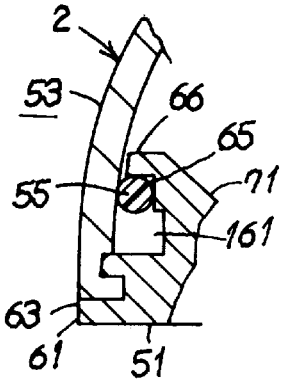
FIG. 43 is a sectional view of a part of the watertight cover mechanism.
Figure 44:
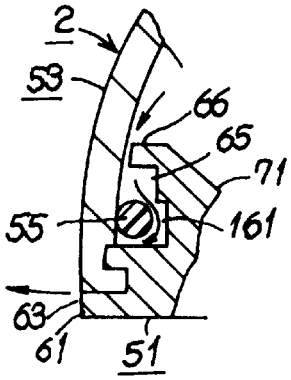
FIG. 44 is a sectional view of a part of the watertight cover mechanism for explaining the pressure releasing function of the watertight cover mechanism.

Next, the ninth embodiment is explained, referring to FIGS. 42 through 44.

The elements having structures and functions similar to those of the embodiments described above are referred to with the same reference numerals and their explanation is omitted in the following.

FIG. 42 is a perspective view of the base member 51 of the watertight cover mechanism 2; FIG. 43 is a sectional view of a part of the watertight cover mechanism 2; and FIG. 44 is a sectional view of a part of the watertight cover mechanism 2 for explaining the pressure releasing function of the watertight cover mechanism.

The ninth embodiment calls for forming one or more inner pressure releasing grooves 161 in the underside of the loop groove 65 of the base member 51. Each inner pressure releasing groove 161 is open at the outer cylindrical surface of the base member 51 and has such dimensions that the depth of the groove, i.e. the dimension extending in the direction of the center of the base member 51, is greater than the depth of the loop groove 65.

Normally, in other words when the pressure in the translucent globe 53 is not higher than a predetermined level, the second sealing member 55 is engaged in the loop groove 65 as shown in FIG. 43, thereby sealing the gap between the base member 51 and the translucent globe 53.

When the pressure in the translucent globe 53 exceeds said predetermined level due to the heat generated by the actuated illuminant 13, of the second sealing member 55 exposed to the pressure, the portions facing the inner pressure releasing grooves 161 are flexed against the resilience of the second sealing member 55 so as to be moved into the inner pressure releasing grooves 161 as shown in FIG. 44. As a result, a very small gap is formed between the second sealing member 55 and each inner pressure releasing groove 161 and releases the expanded air to the outside, thereby balancing the pressures outside and inside the translucent globe 53. When the pressures are balanced, the elasticity of the second sealing member 55 returns the second sealing member 55 to its original position, where the second sealing member 55 performs its sealing function.

Therefore, even if the pressure in the translucent globe 53 is reduced when the light is put out, there is no danger of moisture or contaminants entering the translucent globe 53.

Next, the definitions and technical concepts of the terms referred to in this specification are explained hereunder.

First, the strip-mounted luminaire 1 is explained.

The ribbon cable 11 consists of a flat insulating cover 21 and a plurality of conductive members 22*a*,22*b* (or 22*a*,22*b*, 22*c*), which are arranged side by side along the length of the insulating cover 21 and embedded inside the insulating cover 21 in such a state that they are spaced apart and insulated from one another. If the flexibility of the ribbon cable 11 is desired to be increased, the conductive members 22*a*,22*b* (22*a*,22*b*,22*c*) may be made of a braided conductive material. In that case, a ribbon cable 11 which is even flatter and more flexible can be obtained by using a flatly braided conductive material. An insulating material that has a desired dielectric strength may be used as the insulating cover according to a necessary insulating level.

Although a low ac or dc voltage of 12 V or 24 V is normally used as the voltage applied to the ribbon cable 11, an ac voltage of 100 V or 120 V may be used if it is desired.

The sockets 12 may be arranged on the ribbon cable 11 by molding the sockets 12 integrally with the ribbon cable 11, or molding each socket separately from the ribbon cable 11 and then connecting them to the ribbon cable 11 by an appropriate means.

The sockets 12 may be mounted on the ribbon cable 11 in any desired orientation; for example, illuminants 13 of a single-base type may be attached to the ribbon cable 11 in such a manner that they are positioned perpendicularly to the ribbon cable 11, or each illuminant 13 may be positioned so as to extend nearly in parallel to the lengthwise direction of the ribbon cable 11. In cases where the illuminants 13 are arranged nearly in parallel to the lengthwise direction of the ribbon cable 11, illuminants of a double-base type may be used as the illuminants 13.

The socket(s) 12 may be connected to the ribbon cable 11 by using any appropriate means. An example of such means may call for removing the portions of the insulating cover 21 of the ribbon cable 21 where the contact pieces 27 of each socket 12 will be connected to the cable, placing the contact pieces 27 on the exposed conductive members 22*a*,22*b* (22*a*,22*b*,22*c*), bonding them together by spot-welding, and, thereafter, re-insulating the conductive members 22*a*,22*b* (22*a*,22*b*,22*c*) by covering the exposed portions of the conductive members 22*a*,22*b* (22*a*,22*b*,22*c*) with silicone resin or the like. Another method may call for inserting the connector portions 39, which extend from the contact pieces 27 of each socket 12, from slits formed in the insulating cover 21 of the ribbon cable 11 onto the conductive members 22*a*,22*b* (22*a*,22*b*,22*c*), and mechanically fastening together the ribbon cable 11 and the socket body 26, which are formed of the same kind of material, by means of ultrasonic welding, while pressing the conductive members 22*a*,22*b* (22*a*,22*b*,22*c*) and the connecting portions 39 together so that they are electrically connected. As an yet another example, pressure pins adapted to be forced into the ribbon cable 11 and connected to the conductive members 22*a*,22*b* (22*a*,22*b*,22*c*) may be formed on the contact pieces 27 of each socket 12.

A desired number of sockets 12 may be arranged on the ribbon cable 11 on condition that their power consumption is within the range of the amount of the current permitted by the conductive members 22*a*,22*b* (22*a*,22*b*,22*c*) of the ribbon cable 11. An approximate number of sockets 12 to be installed for conducting in-line illumination of a desired length may be included in the design items to be determined at the time of installation of the lighting fixture, or may be standardized at the manufacturing stage for mass-production of products having the same specification. Furthermore, the ribbon cable 11 may be cut to a desired length.

The sockets 12 may be positioned in any direction so that the illuminants 13 may be positioned perpendicularly or in parallel with the ribbon cable 11, or in any other desired orientation with respect to the ribbon cable 11. In cases where the illuminants 13 are positioned in parallel with the ribbon cable 11, they may extend in parallel with the lengthwise direction of the ribbon cable 11 or perpendicular to the lengthwise direction of the ribbon cable 11.

The illuminants 13 may be incandescent lamps, light-emitting diodes, discharge lamps or light emitting elements of any other desired types. Also, it does not matter whether it is a single-base type or a double-base type. The shape of the bases of the illuminants, too, may be arbitrarily selected from all the known types including, and not limited to, the Edison types, the bayonet types, the wedge types and the fuse types. Furthermore, if the wedge type is chosen, for example, there are several possible selections, such as one having a lead wire bent to each pinch seal portion, or another having a lead wire bent into a semi circle and thus projected from each pinch seal portion.

Examples of the incandescent lamp applicable to the invention include those having a glass bulb 42 which is transparent, photo-diffusing, colored or has a colored cap fitted thereon. The filament 47 may have a desired shape, such as a straight line, a crest-like shape, etc. In case the incandescent lamp is of a baseless type, it does not matter whether the lamp is sealed at one end or at both ends. Taking such factors as the appearance and luminous intensity distribution into consideration, however, a compact incandescent lamp which has no base and is sealed at both ends is suitable for a strip-mounted luminaire 1 of the invention.

Typical examples of such light bulbs may have the following specifications:

EXAMPLE 1

12 V of rated voltage, 5 W of rated power consumption, and 45 lm of luminous flux;

EXAMPLE 2

12V of rated voltage, 10 W of rated power consumption, and 100 lm of luminous flux;

EXAMPLE 3

24V of rated voltage, 5 W of rated power consumption, and 40 lm of luminous flux;

EXAMPLE 4

24V of rated voltage, 10 W of rated power consumption, and 90 lm of luminous flux;

each lamp of these examples has a rated life of 20,000 hours.

In case an illuminant 13 is a discharge lamp, a current-limiting element for stabilizing the discharge may be installed in its socket 12.

Next, the watertight cover mechanism 2 is explained.

The base member 51 is disposed on the front side, i.e. the side where the corresponding socket 12 is mounted, of the ribbon cable 11. The base member 51 has a window 72, which permits the socket 12 to be inserted from the back of the base member 51. In cases where the first sealing member 54 is directly fitted between the outer surface of the socket 12 and the base member 51, the dimensions of the window 72 has to be strictly regulated in order to prevent a dimensional discrepancy from impairing the sealing ability of the sealing member. However, in cases where the first sealing member 54 is disposed outside the socket 12 and seals the gap between the base member 51 and the back end member 52, the dimensions of the window 72 are not strictly limited as long as they are within appropriate ranges. In cases where the first sealing member 54 serves to seal the space around the outer surface of the socket 12, a loop groove 74 defined by the outer surface of the socket 12 and the base member 51 may be provided in order to contain the first sealing member 54.

The back end member 52 is disposed on the back side, i.e. the side opposite the side where the socket 12 is mounted, of the ribbon cable 11. As the ribbon cable 11 is sandwiched between the base member 51 and the back end member 52, the base member 51 and the back end member 52 are secured at the location where the corresponding socket 12 of the strip-mounted luminaire 1 is mounted on the ribbon cable 11.

The translucent globe 53 is open at one end, i.e. the open end 91, and closed at the other end. The term 'translucent globe' means a globe of which at least the part that has to be translucent is so formed as to pass the light. The globe, which may be colored, allows light to pass by being either transparent or photo-diffusing.

In conjunction with the base member 51, the translucent globe 53 serves to enclose the socket 12 and the illuminant 13. Therefore, there is no need of providing the open end 91 with a neck portion. If it is desired, however, a neck portion may be formed. In that case, the translucent globe 53 is watertightly held at its open end 91 by the base member 51.

Then, the socket 12 and the illuminant 13 are enclosed by the base member 51 and the translucent globe 53 with the first sealing member 54, which is attached to the base member 51, sealing and thereby waterproofing the space around the outer surface of the socket 12, while the second sealing member 55 sealing and waterproofing the gap between the base member 51 and the translucent globe 53. Thus, the socket 12 and the illuminant 13 are sealed and waterproofed from the outside. As the socket 12 is enclosed by the base member 51 and the translucent globe 53, its shape is not limited to one that has a circular outline, and a shape elongated in the lengthwise direction of the ribbon cable 11 is acceptable. A watertight cover mechanism 2 for a socket 12 which has a so-called irregular shape may also be provided according to the invention.

As the back end member 52 holds the ribbon cable in conjunction with the base member 51, it is allowed to be formed in the shape of a plate. In other words, the distance by which the base member 51 protrudes in the direction of the back end of the ribbon cable 11 can be reduced to a minimum. This not only facilitates the work of arranging the ribbon cable 11 on the surface of a building 3 but also improves the appearance of the luminaire.

The following is an additional explanation of a luminaire according to the invention.

The first sealing member 54 is positioned between the outer circumferential surface of the socket 12 and the base member 51. When the waterproof sealing is done by disposing the first sealing member 54 between the outer circumferential surface of the socket 12 and the base member 51, there is no need for the back end member 52 to directly contribute to the sealing. However, if it is necessary, the back end member 52 may be so arranged as to hold the first sealing member 54 in order to prevent the first sealing member 54 from accidentally slipping off.

In case the space around the socket 12 is waterproofed by disposing the first sealing member 54 between the base member 51 and the back end member 52, it may be done by use of the configuration which calls for providing the base member 51 with a groove to contain the first sealing member 54 and conduct the sealing by sandwiching the first sealing member 54 between the back end member 52 and said groove, or the configuration which calls for the base member 51 and the back end member 52 to define a groove 143 and conducting the sealing by containing the first sealing member 54 in the groove 143.

A plurality of sockets 12 and illuminants 13 are arranged in the lengthwise direction of the ribbon cable 11. As numerous sets of sockets 12, illuminants 13 and watertight cover mechanisms 2 are arranged on a ribbon cable 11 along the length of the cable, they can be used for what is generally called in-line illumination. As each illuminant 13 is made waterproof against rain or other forms of moisture, it is most suitable to be used outdoors or, in some cases, in water. As an example of applications, the invention offers a novel lighting equipment for light-up illumination, such as illuminating the outline of a bridge or a building, or in-line illumination along a street or a river. This is because an illumination facility can be installed simply by wiring a luminaire of the invention along the outline of such a structure as a bridge, a building or the like. In this case, the luminaire can be installed by securing the ribbon cable 11 or each watertight cover mechanism 2 in an appropriate manner.

The number of sockets 12 to be arranged on the ribbon cable 11 may be set appropriately based on the current capacity of the ribbon cable 11. In case the necessary number of sockets 12 exceeds the limit determined by the current capacity of the ribbon cable 11, the problem can be solved simply by connecting a plurality of ribbon cables 11 in parallel to one another.

In addition to the two conductive members 22*a*,22*b* that are directly connected to the power supply of the ribbon cable 11, a conductive member which is not connected to the power supply (hereinafter referred to as a non-power-supply-connected conductive member) may be used in order to form illuminant groups 13A, 13B, . . . , each of which consists of illuminants connected in series. For this purpose, the non-power-supply-connected conductive member, i.e. the conductive member 22*c* in case of the present embodiment, is divided into a plurality of conductive pieces $\mathbf{101}_1$, $\mathbf{101}_2$, . . . $\mathbf{101}_n$ if it is necessary. A typical method of dividing a non-power-supply-connected conductive member calls for producing a ribbon cable 11 that contains a non-power-supply-connected conductive member in the undivided state and then dividing it by punching out specified portions of the conductive member together with the insulating cover 21 by means of a punch or other tool. After the punching operation, it is sufficient to filling the punched-out portions with an insulating filler, such as silicone, and let the portions stand until the filler becomes solid.

Thus, a plurality of conductive pieces $\mathbf{101}_1$, $\mathbf{101}_2$, . . . $\mathbf{101}_n$ may be formed by dividing a non-power-supply-connected conductive member in accordance with the intervals at which the illuminants 13 are desired to be arranged.

For example, illuminant groups 13A, 13B, . . . , each of which consists of four illuminants 13 connected in series can be formed as follows: first, the socket 12 of the first illuminant $\mathbf{13}_1$ is connected to the first conductive piece $\mathbf{101}_1$ and the conductive member 22*a*, which is connected to one pole of the power supply; the socket 12 of the second illuminant $\mathbf{13}_2$ is connected to the first conductive piece $\mathbf{101}_1$ and the second conductive piece $\mathbf{101}_2$; the socket 12 of the third illuminant $\mathbf{13}_3$ is connected, in the same manner as above, to the second conductive piece $\mathbf{101}_2$ and the third conductive piece $\mathbf{101}_3$; and, finally, the socket 12 of the fourth illuminant $\mathbf{13}_4$ is connected to the third conductive piece $\mathbf{101}_3$ and the other conductive member 22*b*, which is connected to the other pole of the power supply. In other words, the illuminant groups 13A, 13B, . . . are disposed between and connected to a pair of conductive members 22*a*,22*b* that are connected to the power supply, with the illuminants of each illuminant group connected in series via the first through third conductive pieces, i.e. the conductive pieces $\mathbf{101}_1$ through $\mathbf{101}_3$. It can be readily understood that a plurality of illuminant groups 13A, 13B, . . . can be formed between the pair of conductive members 22*a*,22*b* and connected thereto in parallel with one another by sequentially sectioning the non-power-supply-connected conductive member in the lengthwise direction of the ribbon cable 11.

A single non-power-supply-connected conductive member is sufficient in the configuration described above. By providing a plurality of non-power-supply-connected conductive members, however, the illuminant groups 13A, 13B, . . . can be arranged in blocks which may be controlled separately.

The benefit of such a configuration lies in that there is no need of a transformer. This feature is especially beneficial in case of an illumination arranged on a structure situated outdoors, because it is difficult to secure a space for installing a transformer outdoors.

Each socket 12 has a socket body 26 made of an insulating material, and a pair of contact pieces 27. The socket body 26 includes a base portion 28 extending in the lengthwise direction of the ribbon cable 11, and a pair of insertion portions 29 respectively raised from the two lengthwise ends of the base portion 28. Each insertion portion 29 is provided with an insertion groove 30 and a space 31 in such a manner that the two insertion grooves 30 oppose each other and that each space 31 communicates with the corresponding insertion groove 30. The contact pieces 27 penetrate through the insulating cover 21 of the ribbon cable 11 and are connected to the conductive members 22*a*,22*b*. In this state, each contact piece 27 is contained in the space 31 of the corresponding insertion portion 29 and faces the insertion groove 30. Each illuminant 13 is a compact, baseless incandescent lamp comprised of a glass bulb 42 having a pair of pinch seal portions 43 respectively formed at the two opposing ends of the glass bulb 42, a pair of lead wires 46 respectively inserted in the pinch seal portions 43, and a filament 47 disposed in the glass bulb 42. The portion of each lead wire 46 contained in the glass bulb 42 forms a filament supporting portion 44, while the portion outside the glass bulb 42 forms a connector loop 45 adapted to be inserted into an insertion groove 30 of the socket 12 and connected to a contact piece 27. The filament 47 is laid across said pair of filament supporting portions 44 and connected thereto. Each socket 12 may have such a configuration that the pinch seal portions 43 at both ends of the illuminant 13 are respectively inserted into the insertion grooves 30 facing each other or a configuration wherein the lead wires 46 alone are inserted into the insertion grooves 30. As an baseless incandescent lamp may permit its filament 47 to be arranged in a straight line, its luminous intensity distribution can be made suitable for in-line illumination. As the axis of the glass bulb 42 extends in the lengthwise direction of the ribbon cable 11, the distance by which the lamp protrudes from the ribbon cable 11 can be reduced. This feature, together with the fact that the socket 12 is provided with a socket body 26 made of an insulating material, also improves the appearance. Therefore, a luminaire according to the invention is appealing in appearance when installed at a location where the luminaire itself is visible.

The invention also includes a reflector 14 disposed between the base portion 28 of the socket body 26 and the illuminant 13. Disposing the reflector 14 between the illuminant 13 and the base portion 28 of the socket 12 permits the visible rays from the illuminant 13 to be reflected so as to achieve desired characteristics of luminous intensity distribution. In addition, it also enables the reflection of the heat radiated from the illuminant 13. Therefore, even if the illuminant 13 is positioned as close as possible to the base portion 28 of the socket 12, there is no danger of the base portion 28 deteriorating or being damaged by the heat from the illuminant 13. The reflector 14 may be removably attached to the socket body 26.

The base member 51 is formed in a generally disk-like shape and has a pair of fitting portions 67, which are symmetrically formed along the circumferential edge of the back end of the base member 51 and adapted to fit the ribbon cable 11 thereto, a window 72 formed between the pair of fitting portions 67 and adapted to permit the socket 12 to be inserted therein, a pair of arc-shaped base-side fastening portions 68 respectively formed at two opposing sides of the window 72, a window frame portion 73 which is formed on the surface of the base member 51, at a location inside the base-side fastening portions 68 and outside the window 72 and has a first loop groove 74 formed in the inner surface of the base member 51 and adapted to contain the first sealing member 54, and an annular ridge 66 having a second loop groove 65 which is formed around the outer circumferential face of the base member 51 and adapted to contain the second sealing member 55. The back end member 52 is formed in a generally disk-like shape and has seating portion 81 which is formed at the approximate center of the surface of the back end member 52 and adapted to receive the ribbon cable 11 thereon. The back end member 52 also has a pair of arc-shaped backend-side fastening portions 82 flanking said seating portion 81 and adapted to be fastened to the base-side fastening portions 68. The translucent globe 53 has a generally hemi-spherical shape and has a circular open end 91 so that the translucent globe 53 can be attached to the base member 51 with the open end 91 of the translucent globe 53 fitted around the outer circumferential face of the annular ridge 66. Both the base member 51 and back end member 52 have fastening portions projecting outward from the side edges of the ribbon cable 11, and these arc-shaped fastening portions fasten the base member 51 and the back end member 52 together in the state where the ribbon cable 11 is sandwiched therebetween. The fastening portions are fastened to each other by an appropriate means, such as ultrasonic welding or by use of screws or bolts and nuts. As the translucent globe 53 has a circular open end 91 and is so designed as to be attached to the base member 51 by fitting the open end 91 over the annular ridge 66 of the base member 51, the translucent globe 53 can be attached to the base member 51 without the need of considering which way the socket 12 or the illuminant 13 is mounted. The translucent globe 53 may have a generally hemi-spherical outline; in other words, there is no need of forming a neck portion. Therefore, the translucent globe 53 may be formed by injection molding, and, therefore can be produced at a low production cost. In the state where the translucent globe 53 is attached to the base member 51, the friction between the translucent globe 53 and the annular ridge 66 of the base member 51 or the friction between the translucent globe 53 and the second sealing member 55 prevents inadvertent displacement of the translucent globe 53. If it is necessary, however, a displacement prevention mechanism may specially be provided.

According to another feature of the invention, the base member 51 is formed in a generally disk-like shape and has a pair of fitting portions 67, which are symmetrically formed along the circumferential edge of the back end of the base member 51 and adapted to fit the ribbon cable 11 thereto, a window 72 formed between the pair of fitting portions 67 and adapted to have the socket 12 inserted therein, a pair of arc-shaped base-side fastening portions 68 respectively formed at two opposing sides of the window 72, a loop ridge 134 which is formed at a location inside the base-side fastening portions 68 and outside the socket 12 and adapted to contain the first sealing member 54, and an annular ridge 66 having a loop groove 65 which is formed around the outer circumferential face of the base member 51 and adapted to contain the second sealing member 55. The back end member 52 is formed in a generally disk-like shape and has seating portion 81 which is formed at the approximate center of the surface of the back end member 52 and adapted to receive the ribbon cable 11 thereon, a pair of arc-shaped back-end-side fastening portions 82 flanking said seating portion 81 and adapted to be fastened to the base-side fastening portions 68, a ridge portion 141 facing the loop ridge 134 at a distance therewith so that the ridge portion 141 and the loop ridge 134 together define a groove 143 which is adapted to contain the first sealing member 54, and a push portion 142 adapted to push the first sealing member 54 into the groove 143. The translucent globe 53 has a generally hemi-spherical shape and has a circular open end 91 so that the translucent globe 53 can be attached to the base member 51 with the open end 91 of the translucent globe 53 fitted around the outer circumferential face of the annular ridge 66. In other words, this configuration serves to conduct the watertight sealing of the space around the socket 12 without using the socket 12; and the sealing is conducted by disposing the second sealing member 55 between the base member 51 and the back end member 52. Therefore, even if the shapes and/or the dimensions of the outer faces of the sockets 12 are not uniform, such non-uniformity does not impair the sealing function. The shape of each socket 12 has basically no influence on the sealing function. In other words, a desired sealing function can be achieved even if the socket 12 has an irregular shape. Therefore, regardless of the shape of the socket 12, the translucent globe 53 may be formed in any shape that is suitable for the second sealing member 55 to perform the sealing function. As described above, the groove 143 for containing the first sealing member 54 is formed by conjunction of the ridge portion 141 of the back end member 52 with the loop ridge 134 of the base member 51. Therefore, when the back end member 52 and the base member 51 sandwich the ribbon cable 11 in the state where the first sealing member 54 is fitted around the loop ridge 134 of the base member 51 beforehand, the ridge portion 141 of the back end member 52 forms the groove 143 in conjunction with the loop ridge 134 of the base member 51 so that the first sealing member 54 is contained in the groove 143. By fastening the base member 51 and the back end member 52 by use of the fastening means in this state, the push portion 142 pushes the first sealing member 54 further into the groove 143, thereby causing the first sealing member 54 to perform the sealing function. As the ridge portion 141 of the back end member 52 intersects the ribbon cable 11, the ridge portion 141 does not form a complete loop. However, this presents no actual problems, because the ribbon cable 11 itself applies a pressure to the first sealing member 54 at the locations where the ridge portion 141 is notched. In case minute gaps are formed between the ribbon cable 11 and the ridge portion 141, the seal may be reinforced by using silicone or the like to fill the gaps between the ribbon cable 11 and the base member 51 and also between the ribbon cable 11 and the back end member 52.

The base member 51 and the back end member 52 are fastened together by means of ultrasonic welding. As the respective fastening portions of the base member 51 and the back end member 52 have the shape of an arc, both have a sufficient length for ultrasonic welding, and, therefore, can be fastened together with sufficient fastening strength. Once the base member 51 and the back end member 52 are fastened together in the production process at a factory, there will be virtually no need of separating them later. Letting the user separate them apart may bring about various problems, such as deterioration in the sealing function resulting from improper assembly.

In another embodiment, the base member 51 and the back end member 52 are fastened together with tapping screws 146. As the base member 51 and the back end member 52 are fastened together with tapping screws 146, both fastening operation and equipment for the fastening operation can be simplified, and, therefore, the man hours required by the assembly of the luminaire can be reduced. The tapping screws 146 can be screwed from the base member 51 into the back end member 52. However, as the back of the back end member 52 is flat, screwing them from the back face of the back end member 52 makes the fastening operation even easier and also improves the appearance of the luminaire. An appropriate number of tapping screws 146 may be used. In other words, from one to a number of tapping screws 146 may be used for each fastening portion.

In another embodiment, the base member 51 is formed in a generally disk-like shape and has a plurality of catching grooves 69 around its outer edge. The translucent globe 53 has a generally hemi-spherical shape and is provided with a circular open end 91 and a plurality of catching ridges 92, which are formed on the inner wall of the open end 91 and adapted to be engaged in the catching grooves 69 of the base member 51. With the configuration as above, the translucent globe 53 can be attached to the base member 51 by fitting the open end 91 of the translucent globe 53 over the annular ridge 66 of the base member 51 and simply rotating the translucent globe 53 so that the catching ridges 92 of the translucent globe 53 become engaged in the catching grooves 69 of the base member 51. Thus, the mounting of the translucent globe 53 is completed. The engagement of the catching ridges 92 of the translucent globe 53 in the catching grooves 69 of the base member 51 serves as a mechanism to prevent inadvertent displacement of the translucent globe 53.

In yet another embodiment, the base member 51 is formed in a generally disk-like shape and has a plurality of catching lips 131 formed around its outer edge, while the translucent globe 53 has a generally hemi-spherical shape and is provided with a circular open end 91 and a plurality of catching grooves 151, which are formed along the inner edge of the open end 91 and adapted to be engaged with the catching lips 131 of the base member 51. With the configuration as above, the translucent globe 53 can be attached to the base member 51 by fitting the open end 91 of the translucent globe 53 over the annular ridge 66 of the base member 51 and simply rotating the translucent globe 53 so that the catching lips 131 of the base member 51 become engaged in the catching grooves 151 of the translucent globe 53. Thus, the mounting of the translucent globe 53 is completed. The engagement of the catching lips 131 of the base member 51 in the catching grooves 151 of the translucent globe 53 serves as a mechanism to prevent inadvertent displacement of the translucent globe 53. As the catching lips 131 of the base member 51 and the catching grooves 151 of the translucent globe 53 are respectively formed on the outer face of the base member 51 and inside the translucent globe 53, with almost nothing protruding out of the translucent globe 53, this configuration has an appealing appearance.

In yet another embodiment, the back end member 52 is provided with mounting holes 84. The mounting holes 84 formed in the back end member 52 can be used when the luminaire is attached to a building 3 or the like. Other than being used for attaching the luminaire directly to a building 3 or the like, the mounting holes 84 may be used to attach adapters or fixtures to the luminaire prior to attaching the luminaire to a building 3 or the like. Although the mounting holes 84 may be formed anywhere in the back end member 52, it is recommended to form them in the fastening portions so as to not increase the thickness of the back end member 52.

In yet another embodiment, the back end member 52 is provided with mounting holes 84 formed in the back face thereof, and a mounting stay 121 which serves as an adapter and has mounting portions 123 projecting from both sides of the back end member 52. The lighting fixture can be attached to a building 3 by use of the mounting stay 121. When not in use, the mounting stay 121 can be removed. As an unnecessary object can thus be removed, it improves the appearance of the lighting fixture.

In yet another embodiment, the back end member 52 is provided with mounting holes 84, which are formed in the back face thereof, and a mounting saddle 127 to be fastened in said mounting holes 84. This structure is convenient to attach the lighting fixture to a bridge or the like. When providing a bridge or a similar structure with a in-line illumination system, it is often done by arranging a cord-shaped member 126, such as a wire, along the mounting site, and then attaching lighting fixtures to the cord-shaped member 126 so that the lighting fixtures are arranged in a line. Therefore, the object of the above embodiment is to provide a lighting fixture of a simple configuration which can be attached to a cord-shaped member 126. By setting the mounting saddle 127 attached to a cord-shaped member 126 in the mounting holes 84 formed in the back face of the back end member 52, the lighting fixture can be attached to the cord-shaped member 126.

As yet another feature thereof, the invention provides an outdoor illumination system which comprises a lighting fixture mounted on the surface of a building (or other structure) 3 in such a manner that the flat surface of its ribbon cable 11 faces the building (or other structure) 3, a fixing means for affixing the lighting fixture to the building (or other structure) 3, and a power supply connected to the ribbon cable 11. As only a minimal part of the back end member 52 projects from the back of the ribbon cable 11, not only can the lighting fixture be securely mounted on the surface of the building (or other structure) 3 but also it is also appealing in appearance. The aforementioned fixing means may be formed beforehand as an integral body with a member of the watertight cover mechanism 2, for example the back end member 52.

INDUSTRIAL APPLICABILITY

As described above, a watertight cover mechanism for a strip-mounted luminaire, a lighting fixture and an outdoor illumination system according to the present invention are suitable to be used outdoors and also suitable for illuminating the outline of a bridge, a building or the like as well as in-line illumination to be installed along a street or a river.

What is claimed is:

1. A lighting fixture including:

a strip-mounted luminaire including a ribbon cable having a plurality of conductive members embedded in an insulating cover in such a state that the conductive members are insulated from one another, at least one socket and an illuminant set therein, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

wherein the base member is formed in a generally disk-like shape and has a plurality of catching grooves around an outer edge thereof; and the translucent globe has a generally hemi-spherical shape and is provided with a circular open end and a plurality of catching ridges, which are formed on an inner edge of the open end and adapted to be engaged in the catching grooves of the base member.

2. A lighting fixture including:

a strip-mounted luminaire including a ribbon cable having a plurality of conductive members embedded in an insulating cover in such a state that the conductive members are insulated from one another, at least one socket and an illuminant set therein socket, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

wherein:

the base member is formed in a generally disk-like shape and has a plurality of catching lips formed around an outer edge thereof; and the translucent globe has a generally hemi-spherical shape and is provided with a circular open end and a plurality of catching grooves, which are formed along an inner edge of the open end and adapted to be engaged with the catching lips of the base member.

3. A lighting fixture including:

a strip-mounted luminaire including a ribbon cable having a plurality of conductive members embedded in an insulating cover in such a state that the conductive members are insulated from one another, at least one socket and an illuminant set therein, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

the ribbon cable being provided with three or more conductive members, of which at least two conductive members are used to connect the ribbon cable to the power supply while at least one conductive member is not connected to the power supply; a plurality of sockets and illuminants are arranged in a lengthwise direction of the ribbon cable; and a plurality of illuminant groups, each of which consists of a plurality of illuminants connected in series via said conductive member(s) that is (are) not connected to the power supply, are formed, said illuminants groups arranged between the power supply-connected conductive members and connected thereto in parallel with one another.

4. A lighting fixture including:

a strip-mounted luminaire including a ribbon cable having a plurality of conductive members embedded in an insulating cover in such a state that the conductive members are insulated from one another, a socket and an illuminant set in said socket, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

wherein the socket is provided with:

a socket body which is made of an insulating material and includes a base portion extending in the lengthwise direction of the ribbon cable, a pair of insertion portions respectively raised from the two opposing ends of the base portion, a pair of insertion grooves respectively formed in the two insertion portions at the opposing locations, and spaces respectively formed in the two insertion portions in such a manner that each space communicates with the corresponding insertion groove, and the illuminant is a compact, baseless incandescent lamp having:

a glass bulb, a pair of pinch seal portions respectively formed at two opposing ends of the glass bulb, a pair of lead wires respectively and airtightly inserted in the pinch seal portions, each lead wire having the portion that is contained in the glass bulb and forms a filament supporting portion and a portion that is located outside the glass bulb and forms a connector loop adapted to be inserted into the corresponding insertion groove of the socket and connected to the corresponding contact piece, and a filament disposed in the glass bulb in such a manner as to be laid across said filament supporting portions and connected thereto.

5. A lighting fixture including:

a strip-mounted luminaire including a ribbon cable having a plurality of conductive members embedded in an insulating cover in such a state that the conductive members are insulated from one another, a socket and an illuminant set in said socket, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

wherein the socket is provided with:

a socket body which is made of an insulating material and includes a base portion extending in the lengthwise direction of the ribbon cable, a pair of insertion portions respectively raised from the two opposing ends of the base portion, a pair of insertion grooves respectively formed in the two insertion portions at the opposing locations, and spaces respectively formed in the two insertion portions in such manner that each space communicates with the corresponding insertion groove, and a pair of contact pieces which penetrate through the insulating cover of the ribbon cable and are connected to the conductive members in such a state that the contact pieces are respectively contained in the spaces of the insertion portions and face the insertion grooves;

the illuminant is a compact, baseless incandescent lamp having:

a glass bulb, a pair of pinch seal portions respectively formed at two opposing ends of the glass bulb, a pair of lead wires respectively and airtightly inserted in the pinch seal portions, each lead wire having a portion that is contained in the glass bulb and forms a filament supporting portion and a portion that is located outside the glass bulb and forms a connector loop adapted to be inserted into the corresponding insertion groove of the socket and connected to the corresponding contact piece, and a filament disposed in the glass bulb in such a manner as to be laid across said filament supporting portions and connected thereto; and the lighting fixture also includes a reflector disposed between the base portion of said socket body and the illuminant set therein.

6. A lighting fixture including:

a strip-mounted luminaire including a ribbon cable having a plurality of conductive members embedded in an insulating cover in such a state that the conductive members are insulated from one another, at least one socket and an illuminant set therein, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second sealing member for sealing a gap between said base member and the translucent globe;

wherein the base member is formed in a generally disk-like shape and has a pair of fitting portions symmetrically formed along a circumferential edge of a back end of the base member and adapted to fit the ribbon cable to the base member, a window formed between said pair of fitting portions and adapted to permit a socket to be inserted therethrough, a pair of arc-shaped base-side fastening portions respectively formed at two opposing sides of the window, a window frame portion which is formed at a location inside the base-side fastening portions and outside the window and has a first loop groove adapted to contain the first sealing member in such a manner that the first sealing member is positioned between the socket and the first loop groove, and an annular ridge having a second loop groove which is formed around an outer circumferential face of the base member and adapted to contain the second sealing member;

the back end member is formed in a generally disk-like shape and has a seating portion formed at an approximate center of a surface of the back end member and adapted to receive the ribbon cable thereon, and a pair of arc-shaped back-end-side fastening portions flanking said seating portion and adapted to be fastened to the aforementioned base-side fastening portions, and the translucent globe has a generally hemi-spherical shape and has a circular open end so that the translucent globe can be attached to the base member with the open end of the translucent globe fitted around an outer circumferential face of the annular ridge.

7. A lighting fixture including:

a strip-mounted luminaire including a ribbon cable having a plurality of conductive members embedded in an insulating cover in such a state that the conductive members are insulated from one another, at least one socket and an illuminant set therein, said socket piercing through the insulating cover of the ribbon cable and connected to the conductive members;

a base member which is adapted to be disposed on the ribbon cable of the strip-mounted luminaire and provided with a window so formed as to permit said socket to be inserted therethrough;

a back end member adapted to hold said ribbon cable in such manner that the ribbon cable is sandwiched between the base member and the back member;

a translucent globe adapted to be fitted around said base member in such a state as to enclose said socket and the illuminant set in the socket;

a first sealing member adapted to be arranged on said base member so as to watertightly seal a space around the socket;

a second seating member for sealing a gap between said base member and the translucent globe;

wherein:

the base member is formed in a generally disk-like shape and has a pair of fitting portions symmetrically formed along a circumferential edge of the back end of the base member and adapted to fit the ribbon cable to the base member, a window formed between said pair of fitting portions and adapted to permit a socket to be inserted therethrough, a pair of arc-shaped base-side fastening portions respectively formed at two opposing sides of the window, a loop ridge which is formed at a location inside the base-side fastening portions and outside the socket and adapted to contain the first sealing member, and an annular ridge having a loop groove which is formed around the outer circumferential face of the base member and adapted to contain the second sealing member;

the back end member is formed in a generally disk-like shape and has a seating portion formed at an approximate center of a surface of the back end member and adapted to receive the ribbon cable thereon, a pair of arc-shaped back-end-side fastening portions flanking said seating portion and adapted to be fastened to the aforementioned base-side fastening portions, a ridge portion facing facing the aforementioned loop ridge at a distance therewith so that the ridge portion and the loop ridge together form a groove for containing the first sealing member, and a push portion adapted to push the first sealing member into said groove; and the translucent globe has a generally hemi-spherical shape and has a circular open end so that the translucent globe can be attached to the base member with the open end of the translucent globe fitted around an outer circumferential face of the annular ridge.

8. A lighting fixture as claimed in claim 6, wherein a plurality of sockets and illuminants are arranged in a lengthwise direction of the ribbon cable.

9. A lighting fixture as claimed in claim 3, wherein the base member and the back end member are fastened together by means of ultrasonic welding.

10. A lighting fixture as claimed in claim 6, wherein the base member and the back end member are fastened together with tapping screws.

11. A lighting fixture as claimed in claim 6, wherein mounting holes are formed in the back of the back end member.

12. A lighting fixture as claimed in claim 6, wherein said lighting fixture also includes:

mounting holes formed in the back of the back end member; and an adapter which is designed to be fastened in the mounting holes in the back of the back end member and has mounting portions respectively projecting from two opposing locations of the back end member.

13. A lighting fixture as claimed in claim 6, wherein said lighting fixture also includes:

mounting holes formed in the back of the back end member; and a cord-shaped member adapter to be fastened in the mounting holes in the back of the back end member.

* * * * *